US007311586B2

(12) United States Patent
Maloney et al.

(10) Patent No.: US 7,311,586 B2
(45) Date of Patent: Dec. 25, 2007

(54) APPARATUS AND METHOD FOR CHEMICAL-MECHANICAL POLISHING (CMP) HEAD HAVING DIRECT PNEUMATIC WAFER POLISHING PRESSURE

(75) Inventors: Gerard S. Maloney, Milpitas, CA (US); Jason Price, Eugene, OR (US); Scott Chin, Palo Alto, CA (US); Jiro Kajiwara, Cupertino, CA (US); Malik Charif, San Jose, CA (US)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 11/345,199

(22) Filed: Jan. 31, 2006

(65) Prior Publication Data

US 2006/0128277 A1 Jun. 15, 2006

Related U.S. Application Data

(60) Division of application No. 10/027,935, filed on Dec. 21, 2001, now Pat. No. 7,029,382, which is a division of application No. 09/390,142, filed on Sep. 3, 1999, now Pat. No. 6,368,189, which is a continuation of application No. 09/294,547, filed on Apr. 19, 1999, now Pat. No. 6,309,290, which is a continuation-in-part of application No. 09/261,112, filed on Mar. 3, 1999, now Pat. No. 6,231,428.

(51) Int. Cl.
*B24B 1/00* (2006.01)
*B24B 5/02* (2006.01)

(52) U.S. Cl. ..... 451/41; 451/63; 451/288; 451/398

(58) Field of Classification Search ..... 451/41, 451/63, 286, 287, 288, 289, 290, 397, 398
See application file for complete search history.

(56) References Cited

U.S. PATENT DOCUMENTS 3,579,916 A 5/1971 Boetteber (Continued)

FOREIGN PATENT DOCUMENTS

EP 0 383 910 A1 8/1990

(Continued)

OTHER PUBLICATIONS

Tokei, "*Precision one side finish work method*", (Abstracts of Japan, vol. 7, No. 271, Dec. 9, 1983).

(Continued)

*Primary Examiner*—Timothy V. Eley
(74) *Attorney, Agent, or Firm*—Dorsey & Whitney LLP

(57) ABSTRACT

A resilient pneumatic annular sealing bladder is coupled for fluid communication to a first pressurized pneumatic fluid to define a first pneumatic zone and is attached to a first surface of the wafer stop plate adjacent the retaining ring interior cylindrical surface to receive the wafer and to support the wafer at a peripheral edge. The resilient pneumatic annular sealing bladder defines a second pneumatic zone radially interior to the first pneumatic zone and extends between the first surface of the wafer stop plate and the wafer when the wafer is attached to the polishing head during a polishing operation and is coupled for fluid communication to a second pressurized pneumatic fluid. The wafer attachment stop plate is operative during non polishing periods to prevent the wafer from flexing excessively from an applied vacuum force used to hold the wafer to the polishing head during wafer loading and unloading operations.

9 Claims, 24 Drawing Sheets

U.S. PATENT DOCUMENTS

| | | | |
|---|---|---|---|
| 3,631,634 | A | 1/1972 | Weber |
| 3,841,028 | A | 10/1974 | Katzke |
| 4,081,928 | A | 4/1978 | Kinnebrew et al. |
| 4,270,316 | A | 6/1981 | Krämer et al. |
| 4,519,168 | A | 5/1985 | Cesna |
| 4,680,893 | A | 7/1987 | Cronkhite et al. |
| 4,918,869 | A | 4/1990 | Kitta |
| 4,918,870 | A | 4/1990 | Torbert et al. |
| 4,954,142 | A | 9/1990 | Carr et al. |
| 5,205,082 | A | 4/1993 | Shendon et al. |
| 5,212,910 | A | 5/1993 | Breivogel et al. |
| 5,216,843 | A | 6/1993 | Breivogel et al. |
| 5,443,416 | A | 8/1995 | Volodarsky et al. |
| 5,527,209 | A | 6/1996 | Volodarsky et al. |
| 5,547,417 | A | 8/1996 | Breivogel et al. |
| 5,554,064 | A | 9/1996 | Breivogel et al. |
| 5,582,534 | A | 12/1996 | Shendon et al. |
| 5,584,751 | A | 12/1996 | Kobayashi et al. |
| 5,624,299 | A | 4/1997 | Shendon |
| 5,635,083 | A | 6/1997 | Breivogel et al. |
| 5,643,053 | A | 7/1997 | Shendon |
| 5,651,724 | A | 7/1997 | Kimura et al. |
| 5,679,065 | A | 10/1997 | Henderson |
| 5,738,574 | A | 4/1998 | Tolles et al. |
| 5,775,983 | A | 7/1998 | Shendon et al. |
| 5,803,799 | A | 9/1998 | Volodarsky et al. |
| 5,820,448 | A | 10/1998 | Shamouilian et al. |
| 5,857,899 | A | 1/1999 | Volodarsky et al. |
| 5,941,758 | A | 8/1999 | Mack |
| 5,980,361 | A | 11/1999 | Müller et al. |
| 6,019,670 | A | 2/2000 | Cheng et al. |
| 6,024,630 | A | 2/2000 | Shendon et al. |
| 6,033,292 | A | 3/2000 | Inaba |
| 6,077,151 | A | 6/2000 | Black et al. |
| 6,093,089 | A | 7/2000 | Chen et al. |
| 6,093,091 | A | 7/2000 | Keller |
| 6,110,025 | A | 8/2000 | Williams et al. |
| 6,113,480 | A | 9/2000 | Hu et al. |
| 6,116,992 | A | 9/2000 | Prince |
| 6,231,428 | B1 | 5/2001 | Maloney et al. |
| 6,309,290 | B1 | 10/2001 | Wang et al. |
| 6,368,189 | B1 | 4/2002 | Maloney et al. |
| 6,413,459 | B1 * | 7/2002 | Anderson et al. ..... 264/230 |
| 6,540,594 | B2 | 4/2003 | Zuniga et al. |
| 7,029,382 | B2 | 4/2006 | Maloney et al. |

FOREIGN PATENT DOCUMENTS

| | | | |
|---|---|---|---|
| EP | 0 747 167 | A | 12/1996 |
| EP | 0 747 167 | A1 | 12/1996 |
| EP | 0 747 167 | A2 | 12/1996 |
| EP | 2 307 432 | A | 5/1997 |
| EP | 0 791 431 | A1 | 8/1997 |
| EP | 0 841 123 | A1 | 5/1998 |
| EP | 0 847 835 | A1 | 6/1998 |
| EP | 0 881 039 | A | 12/1998 |
| EP | 0 881 039 | A2 | 12/1998 |
| GB | 2 058 618 | A | 4/1981 |
| GB | 0 079 532 | A | 1/1982 |
| GB | 2 058 818 | A | 4/1991 |
| GB | 2 315 694 | A | 2/1998 |
| JP | 50-133596 | | 10/1975 |
| JP | 54-62268 | | 10/1975 |
| JP | 55-157473 | | 12/1980 |
| JP | 56-146667 | | 11/1981 |
| JP | 59-19671 | | 2/1984 |
| JP | 61-193781 | | 8/1986 |
| JP | 60-129522 | | 3/1987 |
| JP | 62-162460 | | 7/1987 |
| JP | 61-52967 | | 3/1988 |
| JP | 1-92064 | | 4/1989 |
| JP | 1-216768 | | 8/1989 |
| WO | WO89/07508 | A1 | 8/1989 |
| WO | WO 00/51782 | A1 | 9/2000 |

OTHER PUBLICATIONS

Hatachi, "*Lapping apparatus*" (Abstracts of Japan, vol. 7, No. 102, Apr. 30, 1983).

* cited by examiner

ONLY LEFT SIDE OF POLISHING HEAD SHOWN

ONLY LEFT SIDE SHOWN

APPARATUS AND METHOD FOR CHEMICAL-MECHANICAL POLISHING (CMP) HEAD HAVING DIRECT PNEUMATIC WAFER POLISHING PRESSURE

RELATED APPLICATIONS

This application is a divisional application of U.S. patent application Ser. No. 10/027,935 filed 21 Dec. 2001, now U.S. Pat. No. 7,029,382, which is a divisional of U.S. patent application Ser. No. 09/390,142 filed 3 Sep. 1999, now U.S. Pat. No. 6,368,189, which is a continuation of U.S. patent application Ser. No. 09/294,547 filed 19 Apr. 1999, now U.S. Pat. No. 6,309,290, which is a continuation in part of U.S. patent application Ser. No. 09/261,112 filed 3 Mar. 1999, now U.S. Pat. No. 6,231,428, each of which is hereby incorporated by reference.

FIELD OF THE INVENTION

The present invention relates to polishing and planarization of substrates including semiconductor materials, and more particularly to a polishing head in which the polishing or planarization pressure is applied by a pneumatic force directly against the backside of the substrate.

BACKGROUND

Modern integrated circuits have literally millions of active devices such as transistors and capacitors formed in or on a semiconductor substrate and rely upon an elaborate system of metal layers, typically comprising multi-level metal layer interconnections, in order to connect the active devices into functional circuits. An interlayer dielectric such as silicon dioxide is formed over a silicon substrate, and electrically isolates a first level of metal layers which is typically aluminum from the active devices formed in the substrate. Metalized contacts electrically couple active devices formed in the substrate to the interconnections of the first level of metal layers. In a similar manner, metal vias electrically couple interconnections of a second level of metal layers to interconnections of the first level of metal layers. Contacts and vias typically comprise a metal such as tungsten surrounded by a barrier metal such as titanium-nitride. Additional layers can be stacked to achieve the desired (multilayer) interconnection structure.

High density multilevel interconnections require the planarization of the individual layers of the interconnection structure and very little surface topography variation. Nonplanar surfaces create poor optical resolution for the photo lithographic procedures used to lay done additional layers in later processing steps. Poor optical resolution prevents the printing of high density lines required for high density circuit and interconnect structures. Another problem associated with surface topography variation pertains to the ability of subsequent metal layers to cover or span the step height. If a step height is too large there is a potential danger that open circuits will be created causing failure of the chip on which the open circuit occurs. Planar interconnect surface layers are a must in the fabrication of state-of-the-art high density multilevel integrated circuits.

Planar substrate topography may be achieved using chemical-mechanical polishing (CMP) techniques. In conventional CMP systems and methods a silicon wafer is placed face down on a rotatable surface or platen covered with a flat polishing pad onto which a coating or layer of an active slurry has been applied. A substrate carrier formed from a rigid metal or ceramic plate mounts the backside of the wafer and applies a downward force against the backside of the wafer so that the front side is pressed against the polishing pad. In some systems, the downward force is generated mechanically such as via a mechanical weight, however, frequently, the downward force is communicated to the substrate carrier via a pneumatic source such as air or other fluid pressure. A resilient layer, often referred to as an insert, such as may be provided by a polymeric material, wax, or other cushioning material may frequently be used between the wafer mounting surface on the carrier and the backside of the wafer. The downward polishing force is communicated through the insert.

A retaining ring circumscribing the periphery of the wafer carrier and the wafer centers the wafer on the carrier and keeps the wafer from slipping out from alignment with the carrier. The carrier which mounts the wafer is coupled to a spindle shaft which is rotated via coupling to a motor. The downward polishing force combined with the rotational movement of pad together with the CMP slurry facilitate the abrasive polishing and planar removal of the upper surface of a thin film or layer from the front side surface of the wafer.

These conventional systems and methods present at least two problems or limitations. A first problem is that an unequal polishing pressure distribution can develop across the surface of the wafer as it is polished either as a result of mechanical misalignments in the carrier or polishing head assembly, interaction of the wafer front side surface with the polishing pad and slurry, nonuniformity of the insert, contamination introduced between the insert and the wafer backside surface such as polishing debris, or a variety of other of sources of polishing force nonuniformity that affect the planarization of the wafer substrate.

The properties of the insert are particularly problematic. While the CMP equipment manufacturer may design and fabricate a device having great precision and process repeatability, it is frequently found that the physical characteristics of the polymeric inserts which must be replaced after some predetermined number of wafers have been processed, and varies from batch to batch. Furthermore, event within a single batch, the characteristics will vary with the amount of water absorbed by the insert. Even more troublesome, different portions of the same insert may be drier or wetter than other areas thereby introducing polishing variations across the surface of each wafer.

A second problem associated with conventional CMP systems and methods is that even to the extent that uniform or substantially uniform polishing pressure may be achieved, see for example copending U.S. patent application Ser. No. 09/261,112 filed 3 Mar. 1999 for a Chemical Mechanical Polishing Head Assembly Having Floating Wafer Carrier and Retaining Ring, and U.S. patent application Ser. No. 09/294,547 filed 19 Apr. 1999 for a Chemical Mechanical Polishing Head Having Floating Wafer Retaining Ring and Wafer Carrier With Multi-Zone Polishing Pressure Control, each of which are assigned to Mitsubishi Materials Corporation, the same assignee as the instant application, and hereby incorporated by reference. uniform polishing pressure may not always be the optimum polishing pressure profile for planarization of the wafer. This apparent paradox between the assumed desirability of a uniform polishing pressure and the need for a non-uniform polishing pressure arises from non-uniform layer deposition effects during the deposition process. To the extent that the deposited layer thickness varies in a known manner, such as the radially varying thickness that is frequently encountered, the polishing pressure may desirably be varied to compensate for the deposition irregularities.

The pressure at any point on the front side surface of the wafer is largely controlled by the local compressive modulus (hardness) and local compression of polishing pad, insert, and any other materials (desired or not) interposed between the source of the pressure and the contact point between the wafer and the polishing pad including the layers between the polishing pad and the generally hard rigid polishing table or platen. Any variation in the amount of compression of these elements results in local pressure variations at the polishing interface.

In general, all other factors being equal (e.g. same slurry composition, same effective linear speed of the wafer across the pad, etc.) the polish removal rate in chemical-mechanical polishing systems is proportional to the pressure applied between the wafer and the polishing pad in the direction perpendicular to the polishing motion. The greater the pressure, the greater the polish removal rate. Thus, nonuniform pressure distribution across the surface of the wafer tends to create a nonuniform polish rate across the surface of wafer. Nonuniform polishing can result in too much material being removed from some parts of wafer and not enough material being removed from other parts, and also cause formation of overly thin layers and/or result in insufficient planarization, both of which degrade semiconductor wafer process yield and reliability.

The nonuniform polishing may be particularly prevalent at the peripheral edge of the wafer where the sharp transition edge effects occur. In traditional approaches, a sharp transition exists between the portion of the polishing pad that is in contact with the polishing head (wafer, wafer carrier, and retaining ring where present) and that portion that is not in contact. Recall that conventional polishing pads are at least somewhat compressible and may be locally compressed, stretched, and deformed in the vicinity of the moving edge of the polishing head as it moves over the surface during polishing. This localized compression, stretching, and other deformation causes a localized variation in the pressure profile proximate the edge of the wafer substrate. This variation is particularly prevalent from the edge of the wafer radially inward for a centimeter or so, but particularly troublesome from the edge inward to about 3 mm to about 5 mm or so.

One solution to reducing this edge variation has been proposed in co-pending U.S. patent application Ser. No. 09/294,547 filed 19 Apr. 1999 and entitled Chemical Mechanical Polishing Head Having Floating Wafer Retaining Ring and Wafer Carrier With Multi-Zone Polishing Pressure Control; and which is hereby incorporated by reference. This patent application describes a novel retaining ring structure that minimizes the amount of pressure variation on the wafer by using a circumscribing retaining ring having a special shape profile.

Now and increasingly in the future, sub-micron integrated circuits (ICs) require that the device surfaced be planarized at their metal inter-connect steps, and chemical mechanical polishing (CMP) is the preferred wafer planarization process. Precise and accurate planarization will become increasingly important as the number of transistors and the required number of interconnections per chip increases.

Integrated circuits are conventionally formed on substrates, particularly silicon wafers, by the sequential deposition of one or more layers, which layers may be conductive, insulative, or semiconductive. These structures are sometimes referred to as the multi-layer metal structures (MIM's) and are important relative to achieving close-packing of circuit elements on the chip with the ever decreasing design rules.

Flat panel displays such as those used in notebook computers, personal data assistants (PDAs), cellular telephones, and other electronic devices, may typically deposit one or more layers on a glass or other transparent substrate to form the display elements such as active or passive LCD circuitry. After each layer is deposited, the layer is etched to remove material from selected regions to create circuitry features. As a series of layers are deposited and etched, the outer or topmost surface of the substrate becomes successively less planar because the distance between the outer surface and the underlying substrate is greatest in regions of the substrate where the least etching has occurred, and the distance between the outer surface and the underlying substrate is least in regions where the greatest etching has occurred. Even for a single layer, the non-planar surface takes on an uneven profile of peaks and valleys. With a plurality of patterned layers, the difference in the height between the peaks and valleys becomes much more severe, and may typically vary by several microns.

A non-planar upper surface is problematic respective of surface photolithography used to pattern the surface, and respective of layers that may fracture if deposited on a surface having excessive height variation. Therefore, there is a need to planarize the substrate surface periodically to provide a planar layer surface. Planarization removes the non-planar outer surface to form a relatively flat, smooth surface and involves polishing away the conductive, semiconductive, or insulative material. Following planarization, additional layers may be deposited on the exposed outer surface to form additional structures including interconnect lines between structures, or the upper layer may be etched to form vias to structures beneath the exposed surface. Polishing generally and chemical mechanical polishing (CMP) more particularly are known methods for surface planarization.

The polishing process is designed to achieve a particular surface finish (roughness or smoothness) and a flatness (freedom from large scale typography). Failure to provide minimum finish and flatness may result in defective substrates, which in tern may result in defective integrated circuits.

During CMP, a substrate such as a semiconductor wafer, is typically mounted with the surface to be polished exposed, on a wafer carrier which is part of or attached to a polishing head. The mounted substrate is then placed against a rotating polishing pad disposed on a base portion of the polishing machine. The polishing pad is typically oriented such that it's flat polishing surface is horizontal to provide for even distribution of polishing slurry and interaction with the substrate face in parallel opposition to the pad. Horizontal orientation of the pad surface (the pad surface normal is vertical) is also desirable as it permits the wafer to contact the pad at least partially under the influence of gravity, and at the very least interact in such manner that the gravitational force is not unevenly applied between the wafer and the polishing pad. In addition to the pad rotation, the carrier head may rotate to provide additional motion between the substrate and polishing pad surface. The polishing slurry, typically including an abrasive suspended in a liquid and for CMP at least one chemically-reactive agent, may be applied to the polishing pad to provide an abrasive polishing mixture, and for CMP an abrasive and chemically reactive mixture at the pad substrate interface. Various polishing pads, polishing slurries, and reactive mixtures are known in the art, and which is combination allow particular finish and flatness characteristics to be achieved. Relative speed between the polishing pad and the substrate, total polishing time, and the pressure applied during polishing, in addition to other factors influence the surface flatness and finish, as well as the uniformity. It is also desirable that the polishing of successive substrates, or where a multiple head polisher is used, all substrates polished during any particular polishing operation are planarized to the same extent, including remove of substantially the same amount of material and providing the same flatness and finish. CMP and wafer polishing generally are well known in the art and not described in further detail here.

The condition of the polishing pad may also affect polishing results, particularly the uniformity and stability of the polishing operation over the course of a single polishing run, and more especially, the uniformity of polishing during successive polishing operations. Typically, the polishing pad may become glazed during one or more polishing operations as the result of heat, pressure, and slurry or substrate clogging. The effect is to lessen the abrasive characteristic of the pad over time as peaks of the pad are compressed or abraded and pits or voids within the pad fill with polishing debris. In order to counter these effects, the polishing pad surface must be conditioned in order to restore the desired abrasive state of the pad. Such conditioning may typically be carried out by a separate operation performed periodically on the pad to maintain its abrasive state. This also assists in maintaining stable operation during which a predetermined duration of polishing will remove a predetermined amount of material from the substrate, achieve a predetermined flatness and finish, and otherwise produce substrates that have sufficiently identical characteristics so that the integrated circuits fabricated from the substrates are substantially identical. For LCD display screens, the need for uniform characteristics may be even more pronounced, because unlike wafers which are cut into individual dies, a display screen which may be several inches across, will be totally unusable if even a small area is unusable due to defects.

An insert, as has conventionally been used is an inexpensive pad that is bonded to the wafer sub-carrier and is between the backside of the wafer and the carrier surface which may be a metal or ceramic surface. Variations in the mechanical characteristics of the insert typically may cause variations in the polishing results of CMP.

In U.S. Pat. No. 5,205,082 there is described a flexible diaphragm mounting of the sub-carrier having numerous advantages over earlier structures and methods, and U.S. Pat. No. 5,584,751 provides for some control of the down force on the retaining ring through the use of a flexible bladder; however, neither these patents describe structure for direct independent control of the pressure exerted at the interface of the wafer and retaining ring, or any sort of differential pressure to modify the edge polishing or planarization effects.

In view of the foregoing, there is a need for a chemical mechanical polishing apparatus which optimizes polishing throughput, flatness, and finish, while minimizing the risk of contamination or destruction of any substrate.

The inventive structure and method incorporate numerous design details and innovative elements, some of which are summarized below. The inventive structures, methods, and elements are described in the detailed description.

SUMMARY

The invention provides a polishing machine and a polishing head structure and method that improves the polishing uniformity of a substrate across the entire surface of the substrate, particularly near the edge of the substrate that is particularly beneficial to improve the uniformity of semiconductor wafers during Chemical Mechanical Polishing (CMP). In one aspect, the invention provides a method of controlling the polishing pressure over annular regions of the substrate, such as a wafer, in a semiconductor wafer polishing machine.

BRIEF DESCRIPTION OF THE DRAWINGS

Additional objects and features of the invention will be more readily apparent from the following detailed description and appended claims when taken in conjunction with the drawings, in which:

DESCRIPTION OF SPECIFIC EMBODIMENTS

The inventive structure and method are now described in the context of specific exemplary embodiments illustrated in the figures.

Figure 1:
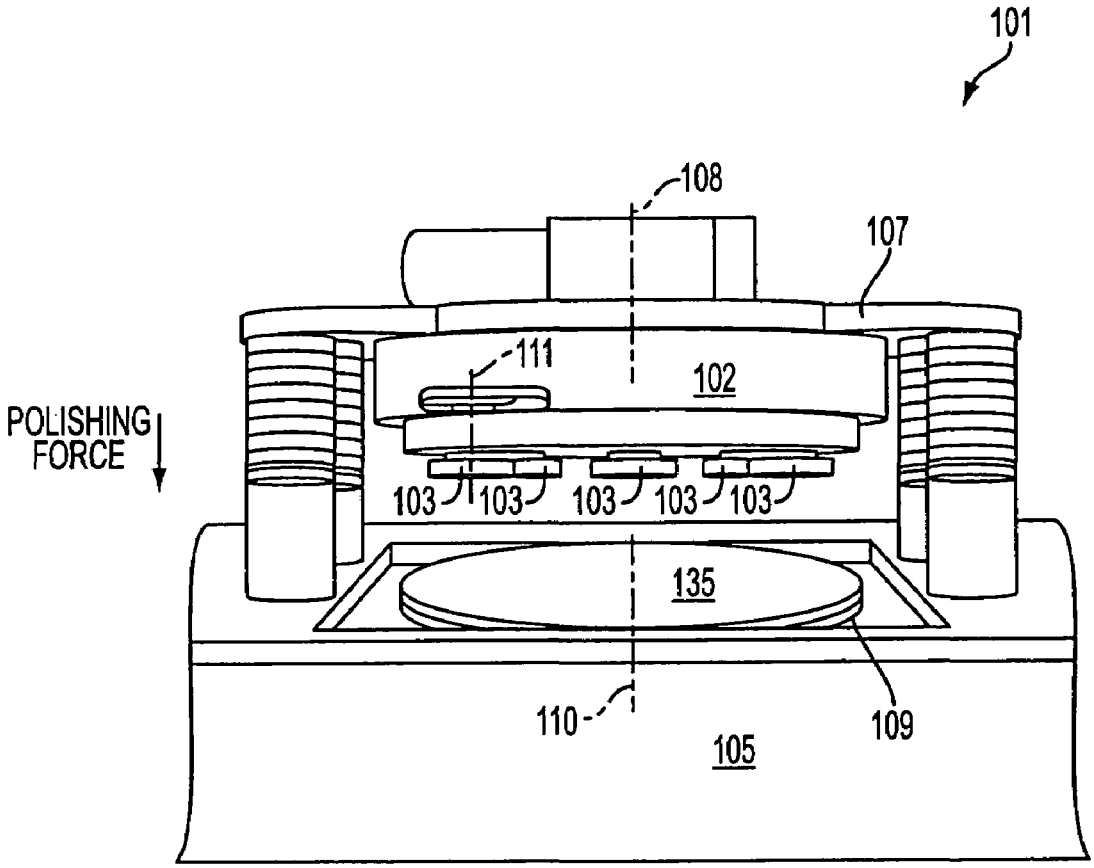
FIG. 1 is a diagrammatic illustration showing an embodiment of a multi-head polishing/planarization apparatus.
Figure 3:
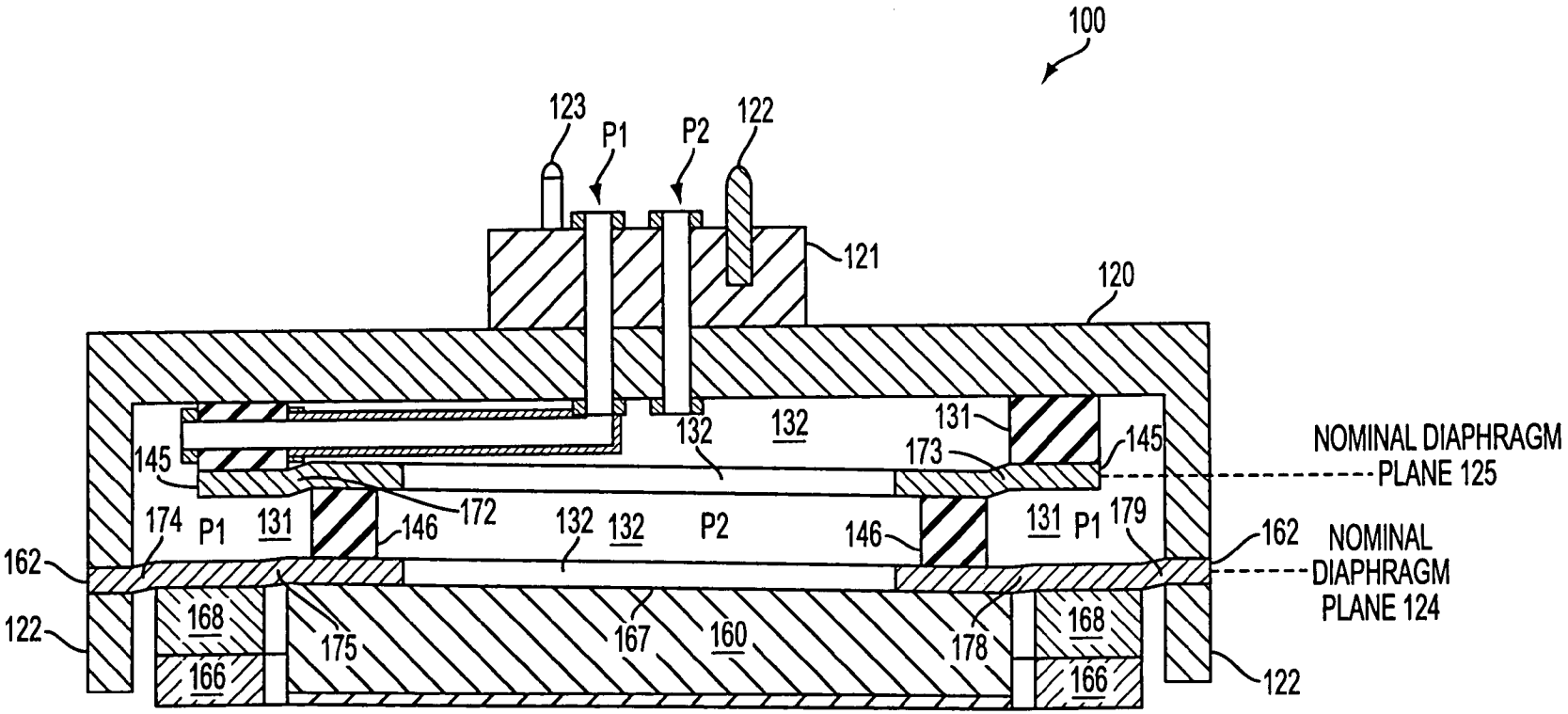
FIG. 3 is a diagrammatic illustration showing a simple embodiment of the inventive two-chambered polishing head in FIG. 2 further illustrating at exaggerated scale the manner in which linking elements (diaphragms) permit movement of the wafer subcarrier and wafer retaining ring.

In FIG. 1, there is shown a chemical mechanical polishing or planarization (CMP) tool 101, that includes a carousel 102 carrying a plurality of polishing head assemblies 103 comprised of a head mounting assembly 104 and the substrate (wafer) carrier assembly 106 (See FIG. 3). We use the term "polishing" here to mean either polishing of a substrate 113 generally including semiconductor wafer 113 substrates, and also to planarization when the substrate is a semiconductor wafer onto which electronic circuit elements have been deposited. Semiconductor wafers are typically thin and somewhat brittle disks having diameters nominally between 100 mm and 300 mm. Currently 200 mm semiconductor wafers are used extensively, but the use of 300 mm wafers is under development. The inventive design is applicable to semiconductor wafers and other substrates at least up to 300 mm diameter, and advantageously confines any significant wafer surface polishing nonuniformities to no more than about the so-called 2 mm exclusion zone at the radial periphery of the semiconductor disc, and frequently to an annular region less than about 2 mm from the edge of the wafer.

A base 105 provides support for the other components including a bridge 107 which supports and permits raising and lowering of the carousel with attached head assemblies. Each head mounting assembly 104 is installed on carousel 102, and each of the polishing head assemblies 103 are mounted to head mounting assembly 104 for rotation, the carousel is mounted for rotation about a central carousel axis 108 and each polishing head assembly 103 axis of rotation 111 is substantially parallel to, but separated from, the carousel axes of rotation 108. CMP tool 101 also includes the motor driven platen 109 mounted for rotation about a platen drive axes 110. Platen 109 holds a polishing pad 135 and is driven to rotate by a platen motor (not shown). This particular embodiment of a CMP tool is a multi-head design, meaning that there are a plurality of polishing heads for each carousel; however, single head CMP tools are known, and inventive head assembly 103, retainer ring 166, and method for polishing may be used with either a multi-head or single-head type polishing apparatus.

Furthermore, in this particular CMP design, each of the plurality of heads are driven by a single head motor which drives a chain (not shown), which in turn drives each of the polishing heads 103 via a chain and sprocket mechanism; however, the invention may be used in embodiments in which each head 103 is rotated with a separate motor. The inventive CMP tool also incorporates a rotary union 116 providing five different gas/fluid channels to communicate pressurized fluids such as air, water, vacuum, or the like between stationary sources external to the head and locations on or within the wafer carrier assembly 106. In embodiments of the invention in which the chambered subcarrier is incorporated, additional rotary union ports are included to provide the required pressurized fluids to the additional chambers.

In operation, the polishing platen 109 with adhered polishing pad 135 rotates, the carousel 102 rotates, and each of the heads 103 rotates about their own axis. In one embodiment of the inventive CMP tool, the carousel axis of rotation is off-set from the platen axis of rotation by about one inch. The speed at which each component rotates is selected such that each portion on the wafer travels substantially the same distance at the same average speed as every other point on a wafer so as to provide for uniform polishing or planarization of the substrate. As the polishing pad is typically somewhat compressible, the velocity and manner of the interaction between the pad and the wafer where the wafer first contacts the pad is a significant determinant of the amount of material removed from the edge of the wafer, and of the uniformity of the polished wafer surface.

A polishing tool having a plurality of carousel mounted head assemblies is described in U.S. Pat. No. 4,918,870 entitled Floating Subcarriers for Wafer Polishing Apparatus; a polishing tool having a floating head and floating retainer ring is described in U.S. Pat. No. 5,205,082 Wafer Polisher head Having Floating Retainer Ring; and a rotary union for use in a polisher head is described in U.S. Pat. No. 5,443,416 and entitled Rotary Union for Coupling Fluids in a Wafer Polishing Apparatus; each of which are hereby incorporated by reference.

In one embodiment, the inventive structure and method provide a two-chambered head having a disc shaped subcarrier having an upper surface 163 interior to the polishing apparatus and a lower surface 164 for mounting a substrate (i.e. semiconductor wafer) 113 and an annular shaped retaining ring 166 disposed coaxially with, and fitting around both, the lower portion of the subcarrier 160 and around the edge of the wafer substrate 113 to maintain the substrate directly underneath and in contact with the subcarrier 160 and a polishing pad surface 135 which itself is adhered to the platen 109. Maintaining the wafer directly underneath the subcarrier is important for uniformity as the subcarrier imposes a downward polishing force onto the back side of the wafer to force the front side of the wafer against the pad. One of the chambers (P2) 132 is in fluid communication with carrier 160 and exerts a downward polishing pressure (or force) during polishing on the subcarrier 160 and indirectly of the substrate 113 against the polishing pad 135 (referred to as "subcarrier force" or "wafer force"). The second chamber (P1) 131 is in fluid communication with the retaining ring 166 via a retaining ring adapter 168 and exerts a downward pressure during polishing of the retaining ring 166 against the polishing pad 135 (referred to as "ring force"). The two chambers 131,132 and their associated pressure/vacuum sources 114, 115 permit control of the pressure (or force) exerted by the wafer 113 and separately by the retaining ring 166 against the polishing pad surface 135.

While in one embodiment of the invention the subcarrier force and ring force are selected independently, the structure can be adapted to provide greater and lesser degrees of coupling between the ring force and subcarrier force. By making appropriate choices as the properties of a linkage between a head housing supporting structure 120 and the subcarrier 160, and between the subcarrier 160 and the ring 166, degrees of independence in the range from independent movement of the subcarrier and ring to strong coupling between the subcarrier and ring can be achieved. In one embodiment of the invention, the material and geometrical characteristics of linking elements formed in the manner of diaphragms 145, 162 provide optimal linking to achieve uniform polishing (or planarization) over the surface of a semiconductor wafer, even at the edges of the substrate.

Additional embodiments of the invention having a chambered subcarrier are also described. These chambered subcarriers add additional pressure chambers that permit even greater control of the polishing force as a function of position.

In another embodiment, the size and shape of the retaining ring 166 is modified compared to conventional retaining ring structures in order to pre-compress and/or condition the polishing pad 135 in a region near the outer peripheral edge of the substrate 113 so that deleterious affects associated with the movement of substrate 113 across pad 135 from one area of the pad to another are not manifested as non-linearities on the polished substrate surface. The inventive retaining ring 166 acts to flatten out the pad 135 at the leading and training edges of motion so that before the advancing substrate contacts a new area of the pad, the pad is essentially flat and coplanar with the substrate surface; and, as contact between the substrate and the pad is about to end, the pad is kept flat and coplanar with the polished surface of the substrate. In this way, the substrate always experiences a flat, precompressed, and substantially uniform polishing pad surface.

The retaining ring pre-compresses the polishing pad before it travels across the wafer surface. This results in the whole wafer surface seeing a polishing pad with the same amount of pre-compression which results in a move uniform removal of material across the wafer surface. With independent control of the retaining ring pressure it is possible to modulate the amount of polishing pad pre-compression, thus influencing the amount of material removed from the wafer edge. Computer control, with or without feedback, such as using end point detection means, can assist in achieving the desired uniformity.

Figure 2:
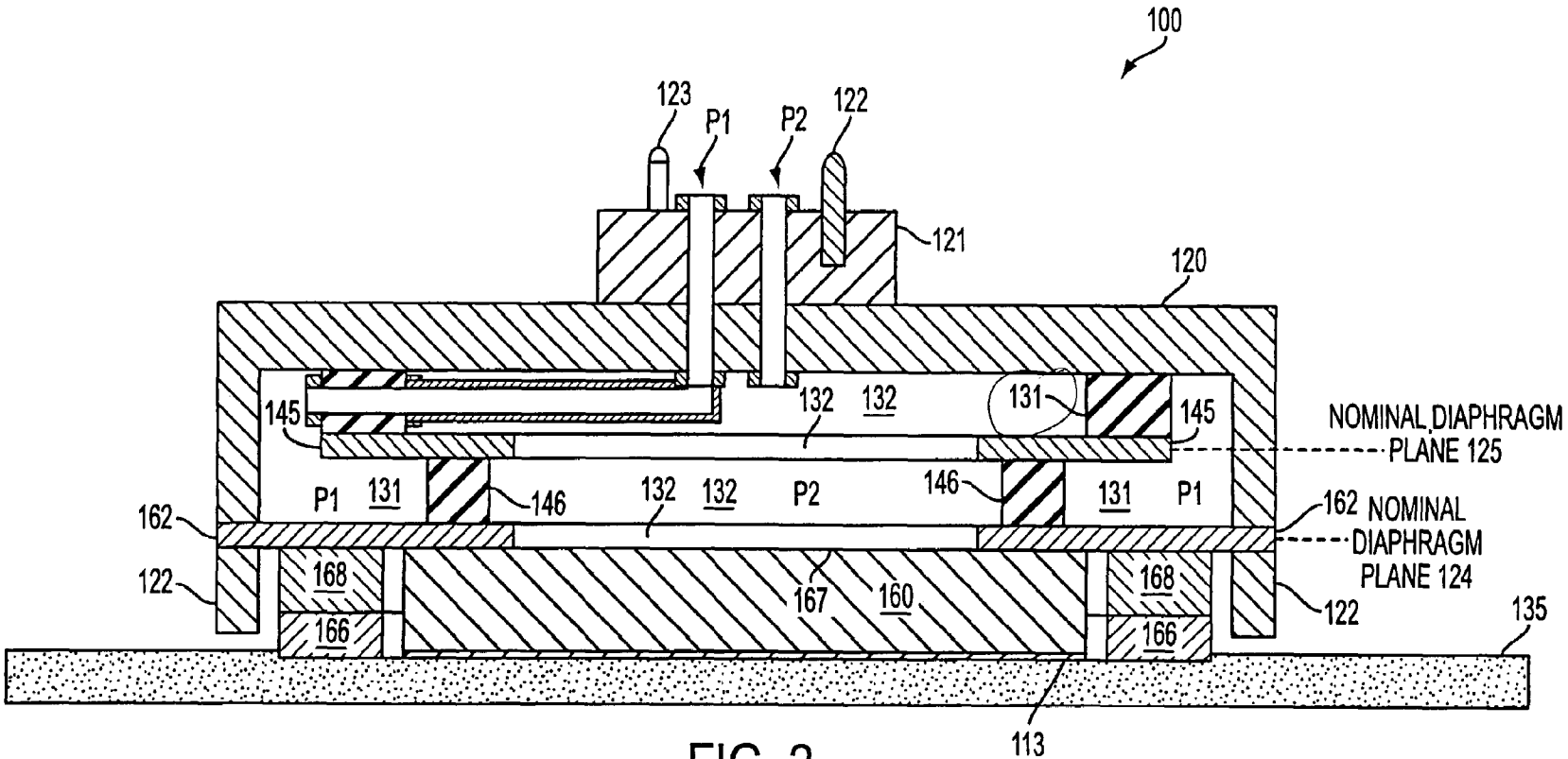
FIG. 2 is a diagrammatic illustration showing a simple embodiment of the inventive two-chambered polishing head.

We first turn our attention to a simple first embodiment of the inventive two-chambered polishing head 100 shown in FIG. 2 to illustrate the manner in which selected aspects of the invention operate. In particular we show and describe the manner in which pressure to the retaining ring assembly (including retaining ring adapter 168 and retaining ring 166) and the carrier 160 are effectuated and controlled. We will then describe other aspects of the invention relative to somewhat more elaborate alternative embodiments that include additional optional, but advantageous features.

Turret mounting adapter 121 and pins 122, 123 or other attachment means facilitate alignment and attachment or mounting of housing 120 to a spindle 119 mounted for rotation relative to carousel 102, or in single head embodiments, to other supporting structure, such as an arm that moves the head across the surface of the pad while the head and pad are rotating. Housing 120 provides a supporting structure for other head components. Secondary diaphragm 145 is mounted to housing 120 by spacer ring 131 to separate secondary diaphragm from housing 120 to allow a range of vertical and angular motion of the diaphragm and structures attached thereto (including carrier 160) relative to a nominal secondary diaphragm plane 125. (The primary and secondary diaphragms also permit some small horizontal movement as a result of the angular tilt alone or in conjunction with vertical translation that is provided to accommodate angular variations at the interface between the carrier-pad and retaining ring-pad interfaces, but this horizontal movement is typically small compared to the vertical movement.)

Spacer ring 131 may be formed integrally with housing 120 in this embodiment and provide the same function; however, as will be described in an alternative embodiment (See for example, FIG. 5) spacer ring 131 is advantageously formed from a separate piece and attached to the housing with fasteners (such as screws) and concentric O-ring gaskets to assure the attachment is air- and pressure-tight.

Carrier 160 and retaining ring assembly 165 (including retaining ring adapter 168 and retaining ring 166) are similarly attached to primary diaphragm 162 which itself is attached to a lower portion of housing 162. Carrier 160 and retaining ring 166 are thus able to translate vertically and tilt to accommodate irregularities in the surface of the pad and to assist in flattening the polishing pad where the pad first encounters retaining ring 166 proximate the edge of the wafer 113. Generically, this type of diaphragm facilitated movement has been referred to as "floating," the carrier and retaining ring as "floating carrier" and "floating retaining ring", and a head incorporating these elements has been referred to as a "floating head" design. While the inventive head utilizes "floating" elements, the structure and method of operation are different than that known in the art heretofore.

Flange ring 146 connects secondary diaphragm 145 to an upper surface 163 of subcarrier 160 which itself is attached to primary diaphragm 162. Flange ring 146 and subcarrier 160 are effectively clamped together and move as a unit, but retaining ring assembly 167 is mounted only to the primary diaphragm and is free to move subject only to constraints on movement imposed by the primary and secondary diaphragms. Flange ring 146 links primary diaphragm 162 and secondary diaphragm 145. Frictional forces between the diaphragm and the flange ring and subcarrier assist in holding the diaphragm in place and in maintaining a tension across the diaphragm. The manner in which primary and secondary diaphragms permit translational and angular movement of the carrier and retaining ring is further shown by the diagrammatic illustration in FIG. 3, which shows a greatly exaggerated condition in which the nominal planar conformation of each diaphragm 145, 162 is altered to permit the translational and angular degrees of freedom. This exaggerated degree of diaphragm flexation illustrated in the figure, especially in angular orientation, would not be expected to be encountered during polishing, and the vertical translation would typically be experienced only during wafer loading and unloading operations. In particular, secondary diaphragm 145 experiences some flexing or distortion in first and second flexation regions 172, 173 in the span between attachment to seal ring 131 and flange ring 146; and primary diaphragm experiences different flexing or distortion at third, fourth, fifth, and sixth flexation regions 174, 175, 178, 179 where it spans its attachments to housing 120 and carrier 160.

In this description, the terms "upper" and "lower" conveniently refer to relative orientations of structures when the structure being described is used in its normal operating state, typically as shown in the drawings. In the same manner, the terms "vertical" and "horizontal" also refer to orientations or movements when the invention or an embodiment or element of an embodiment is used in its intended orientation. This is appropriate for a polishing machine, as wafer polishing machines of the type known by the inventors provide for a horizontal polishing pad surface which fixes the orientations of other polisher components.

Figure 4:
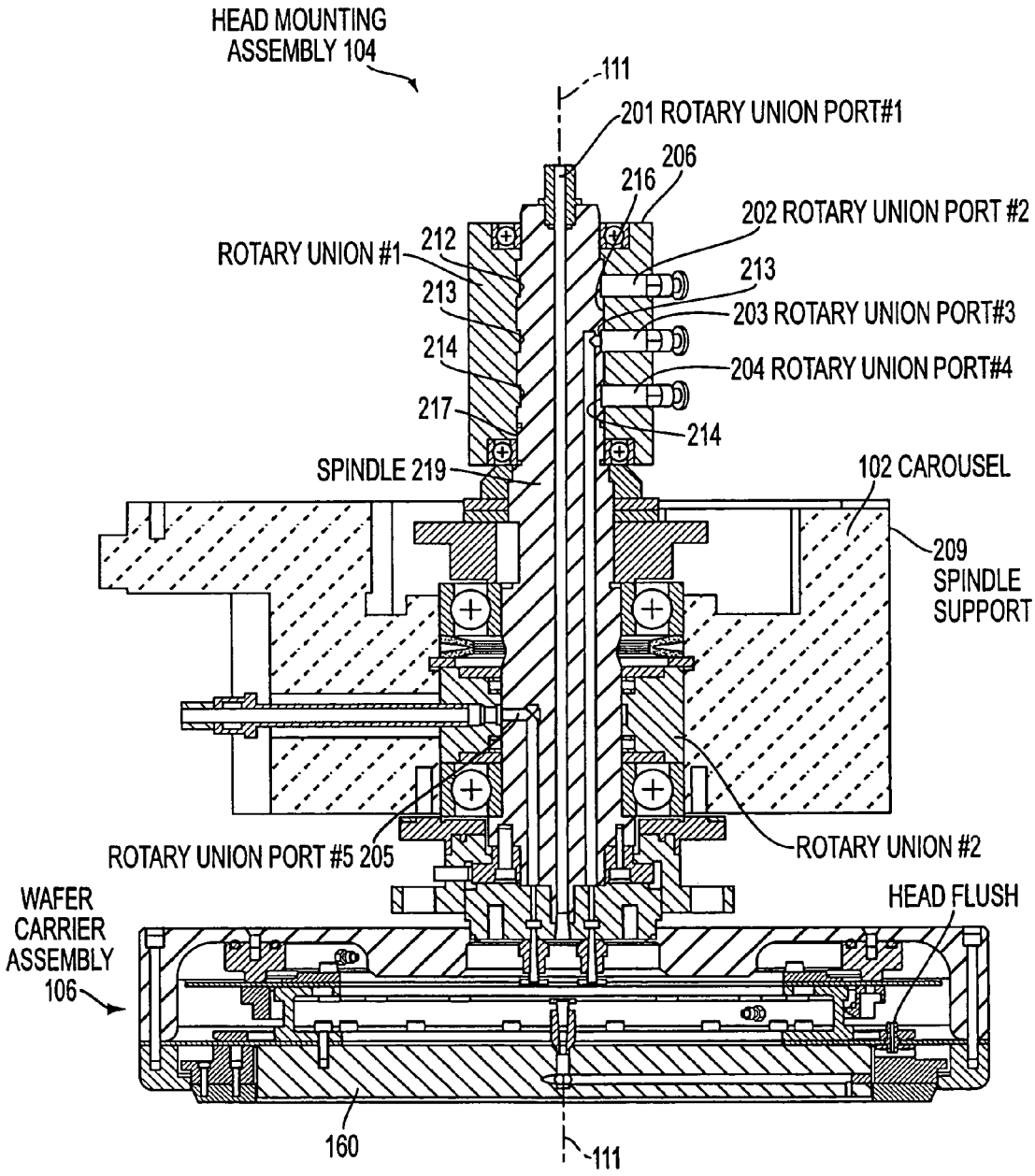
FIG. 4 is a diagrammatic illustration showing a sectional assembly drawing of embodiments of portions of the carousel, head mounting assembly, rotary unions, and wafer carrier assembly.

We next turn our attention to the alternative and somewhat more sophisticated embodiment of the inventive polishing head assembly 103 illustrated in FIG. 4. Particular emphasis is directed toward wafer carrier assembly 106; however, the rotary union 116 and head mounting assembly 104 components of the polishing head assembly 103 are also described. We note that although some structures in the first embodiment of the invention (See FIG. 2) have somewhat different structures from those illustrated for this alternative embodiment (See FIG. 4) identical reference numbers have been retained so that the similar functions provided by the elements in the several embodiments is made clear.

Polishing head assembly 103 generally includes a spindle 119 defining a spindle axis of rotation 111, a rotary union 116, and spindle support means 209 including bearings that provide means for attaching spindle 119 into a spindle support which is attached to the bridge 107 in a manner that permits rotation of the spindle. These spindle support structures are known in the mechanical arts and not described here in any detail. Structure within the spindle is illustrated and described as that structure pertains to the structure and operation of rotary union 116.

Rotary union 116 provides means for coupling pressurized and non-pressurized fluids (gases, liquids, vacuum, and the like) between a fluid source, such as vacuum source, which is stationary and non-rotating and the rotatable polishing head wafer carrier assembly 106. The rotary union is adapted to mount to the non-rotatable portion of the polishing head and provides means for confining and continually coupling a pressurized or non-pressurized fluid between a non-rotatable fluid source and a region of space adjacent to an exterior surface of the rotatable spindle shaft 119. While a rotary union is specifically illustrated in the embodiment of FIG. 4, it will be understood that rotary unions are applicable to the other embodiments of the invention.

One or more fluid sources are coupled to rotary union 116 via tubing and control valve (not shown). Rotary union 116 has a recessed area on an interior surface portion which defines a typically cylindrical reservoir 212, 213, 214 between interior surface portion 216 of rotary union 116 and the exterior surface 217 of spindle shaft 119. Seals 218 are provided between the rotatable shaft 119 and the nonrotatable portion of the rotary union to prevent leakage between the reservoirs and regions exterior to the reservoirs. Conventional seals as are known in the mechanical arts may be used. A bore or port 201 is also provided down the center of the spindle shaft to communicate a fluid via a rotatable coupling.

Spindle shaft 119 has multiple passageways, in one embodiment five passageways, extending from the exterior shaft surface and the top of the shaft to a hollow bores within the spindle shaft. Due to the particular sectional view in FIG. 4, only three of the five passageways are visible in the drawing. From each bore the vacuum or other pressurized or non-pressurized fluids are communicated via couplings and or tubing within the wafer carrier assembly 106 to the location at which the fluid is required. The precise location or existence of the couplings are an implementation detail and not important to the inventive concept except as described hereinafter. These recited structures provide means for confining and continually coupling one or more pressurized fluids between the region adjacent to the exterior surface of the rotatable shaft and the enclosed chamber, but other means may be used. A rotary union that provides fewer channels than that in this particular embodiment of the invention is described in U.S. Pat. No. 5,443,416 and entitled Rotary Union for Coupling Fluids in a Wafer Polishing Apparatus, incorporated herein by reference.

Figure 5:
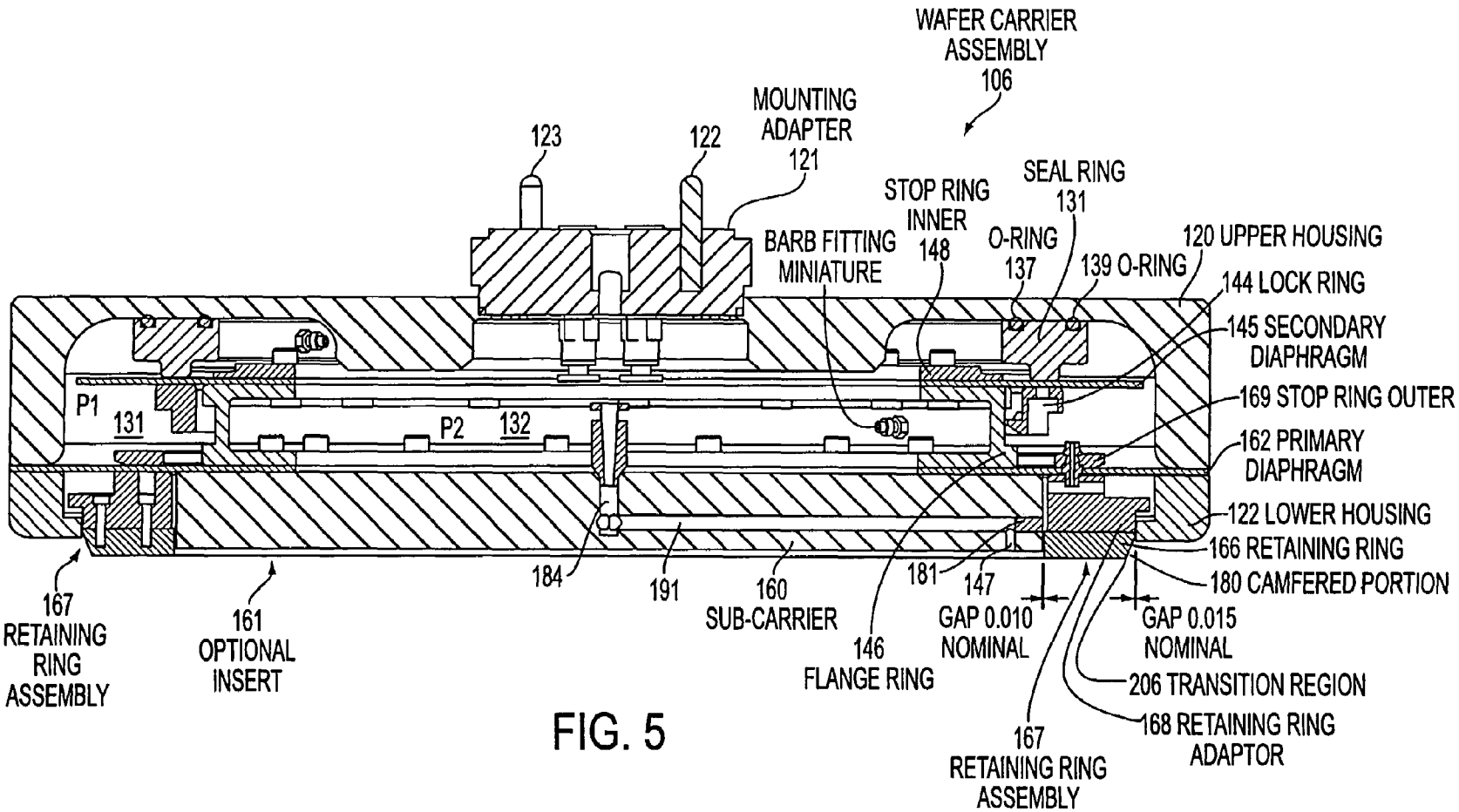
FIG. 5 is a diagrammatic illustration showing a more detailed sectional view of an embodiment of the inventive wafer carrier assembly.

An exemplary embodiment of a wafer polishing head and wafer carrier assembly 106 is illustrated in FIG. 5 which also appears in copending U.S. patent application Ser. No. 09/294,547 filed 19 Apr. 1999 and herein incorporated by reference. Another example of a wafer polishing head is shown and described in U.S. Pat. No. 5,527,209 entitles Wafer Polishing Head Adapted for Easy Removal of Wafers. These polishing head structures are referenced to illustrate in general terms and by way of example, not by limitation, the type of polishing head that the inventive structures may be used with. In general, each of the exemplary embodiments described below id directed toward a modification of the wafer holding method and structure, and the manner in which polishing pressure is applied to the wafer to achieved the desired polishing effect. The embodiments of the invention are not limited to any particular polishing head design or structure, retaining ring structure, housing configuration, or any other limitations not identified as a requirement. For this reason, the description focuses primarily on the relationship between the wafer and the structure and method for holding the wafer.

Those workers having ordinary skill in the art will appreciate in connection with the disclosure provided here that the inventive structures may be applied with suitable modifications that are within the skill of a worker in the field that the inventive structures and methods may be applied to a vast range of polishing head designs, planarization heads and methods, and is not limited to the particular floating head, floating carrier, floating retaining, ring or the like structures shown or described here. Rather each embodiment may be applied to various different types of polishing machines.

#1. Embodiment Wherein a Controlled Air Pressure is Applied to a Retaining Ring, Sub-Carrier the Back Side of Wafer Using Face Seal.

Figure 6:
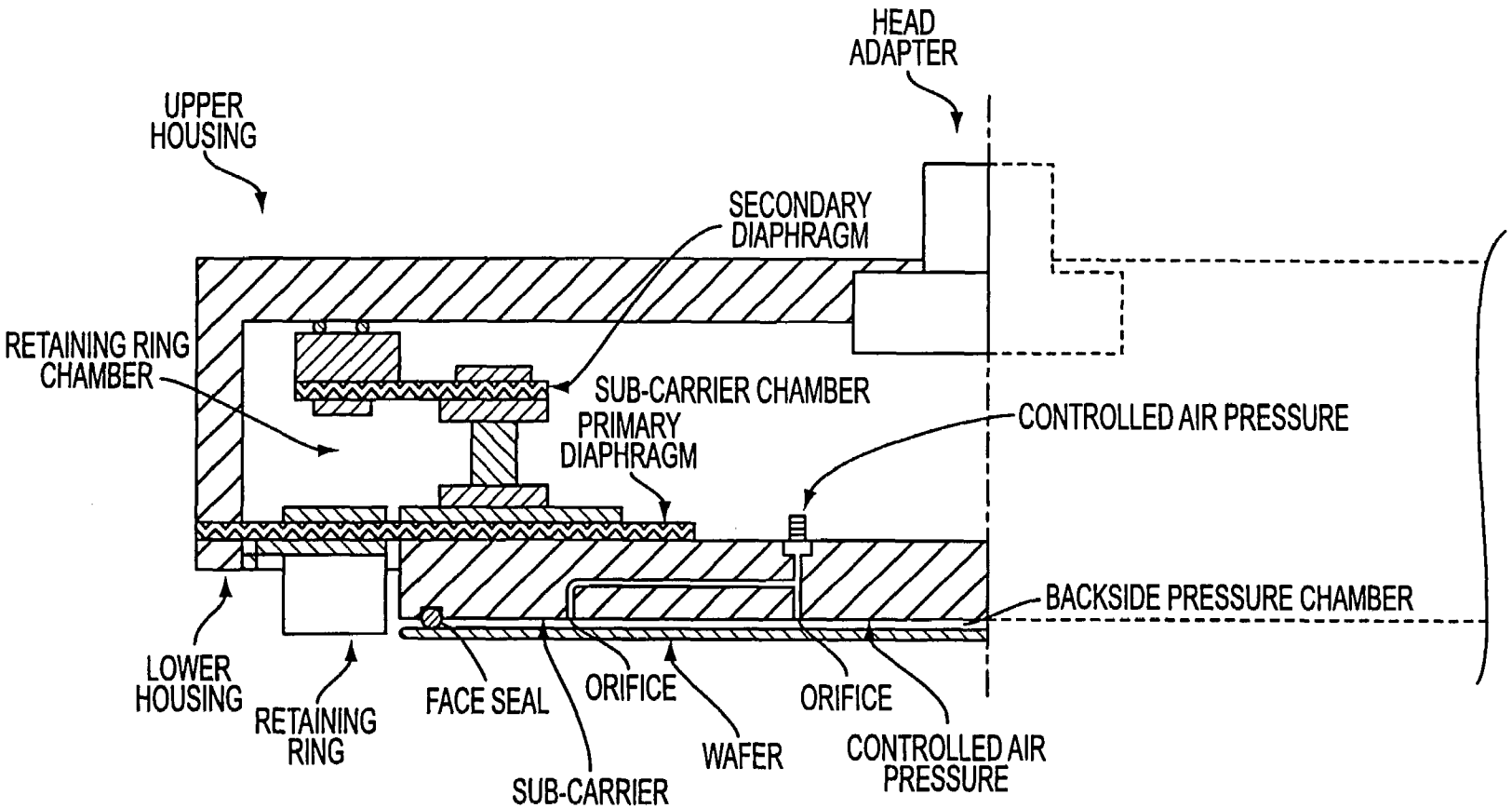
FIG. 6 is a diagrammatic illustration showing a first primary embodiment of the invention.

With respect to FIG. 6, there is shown a first primary embodiment of the invention. In this embodiment, a wafer subcarrier is provided but the wafer subcarrier does not actually carry, hold, or mount the substrate (such as a semiconductor wafer) as in conventional polishing head designs and implementations. Rather, the face of the subcarrier that opposes the polishing pad has an annular face seal attached which makes contact with the substrate to be polished. The annular face seal is mounted near the outer circumferential edge of the subcarrier, but not necessarily at outer peripheral edge as it is intended to be interposed between the back side face of the wafer and the downward facing surface of the subcarrier. (Note that the downward facing surface of the subcarrier is the surface that opposes the polishing pad during a polishing operation.)

Just prior to beginning a polishing operation, the back side surface of a substrate, such as a semiconductor wafer, is placed against the annular shaped face seal. The face seal may be attached to the subcarrier in various ways. For example, in one embodiment the face seal is bonded to the subcarrier. In another embodiment, a grooved channel is provided in the downward facing face of the subcarrier to receive the face seal, which may be secured either by bonding, by press friction fit, by an interlocking groove, or other conventional ways in which a somewhat resilient member may be inserted and held into a rigid machinable structure, such as a metal or ceramic subcarrier.

Independent of how the face seal is attached to the subcarrier, the face seal should be sized and attached in such manner that a lower surface portion of the face seal extends above the subcarrier surface so that when a semiconductor is mounted, a backside pocket or back side pneumatic chamber is created between the back side of the wafer and the downward facing surface of the subcarrier. The amount of extension or pocket depth should be such that when the semiconductor wafer is mounted to the subcarrier though the face seal, the wafer does not contact the subcarrier surface either (i) when a vacuum is applied to hold the wafer to the face seal immediately before and immediately after polishing, or (ii) when a polishing pressure is applied in the backside pneumatic chamber and the wafer is pressed against the polishing pad. The actual pocket depth depends on several factors, including the material from which the face seal is fabricated in that a more compressible material usually requiring a greater depth than a less compressible material, the diameter of the substrate or wafer being held in that a larger substrate may be expected to bow inward (toward the subcarrier) when a holding vacuum is applied and to be pressed inward (particularly in the center of the wafer where less support is provided by the face seal itself) than a smaller substrate, and the range of vacuum and positive polishing pressures applied, among other factors. Pocket depths between about 0.5 mm and about 5 mm may be used, but a pocket depth of between about 1 mm and about 2 mm are typical for a 200 mm wafer polishing head. In one embodiment of the invention, a face seal having a bendable lip is used such that sealing is provided by deforming a bendable annular lip against the wafer. In another embodiment of the invention, a somewhat soft compressible rubber or polymeric material is used in the manner of an "O-ring" to create the seal.

The vacuum (negative pressure) holding force and the positive polishing pressure are provided from at least one hole at the downward facing surface of the subcarrier that is in fluid communication with a source of pressurized fluid. Pressurized gas, usually air, from a source of pressurized air may advantageously be used. A plurality of such holes or orifices may optionally be provided at the subcarrier surface, and may be advantageous for quickly and uniformly changing the pressure on the wafer backside. In like manner, the source of vacuum may be communicated via the same holes or via different holes. Typically, the pressurized gas is communicated to the holes or orifices by attaching a fitting to the upper side of subcarrier, providing channels or a manifold of channels within the subcarrier, and connecting the channels or manifold of channels with orifices opening onto the surface of the subcarrier. It is noted that as the orifices are separated from the backside of the wafer by a space, polishing is not sensitive to the location or size of the orifices as compared to conventional polishing heads in which the orifices contact the wafer directly or through a polymeric insert.

In operation a wafer is positioned in the pocket formed by the retaining ring which extends slightly beyond the subcarrier and face seal during a wafer loading operation, and is held in place against the face seal by a vacuum. The polishing head, including the retaining ring, subcarrier, face seal, and attached wafer are then positioned in opposition against the polishing pad. Usually, both the polishing head and the polishing pad are moved in an absolute sense but certainly relative to each other so that uniform polishing and planarization are achieved.

The inventive structure applied pressure directly against the backside of the wafer (except where the face seal is located) so that localized pressure variations such as might result from variation in the properties of the polishing insert, occurrence of contaminants between the wafer backside and the insert or subcarrier face, non-flatness of the insert or subcarrier surface, or the like do not occur. As some pressure variation may possibly occur as a result of the presence of the face seal, the face seal is desirably located proximate the peripheral edge of the wafer in the so called edge exclusion region, and be only so wide (the difference between the annular inner radius and the annular outer radius) to provide a reliable seal. Usually a width of from about 1 mm to about 3 mm may be used, but lesser or greater widths may be employed. Note that when a pure pneumatic pressure is applied to the backside polishing chamber, the downward polishing pressure is uniform independent of any contaminants that may be present on the wafer backside. Thus more uniform polishing is provided.

Although we have shown and described what appears to be a conventional subcarrier structure relative to this embodiment, it is noted that the particular characteristics of the subcarrier are not important as the subcarrier does not actually mount the wafer and is not responsible for presenting a flat or planar surface against which the wafer mounts, directly or through an insert. For example, the surface of the subcarrier may be non-planar so long as the face seal is mounted in such manner that its contacting surface is sufficiently planar so that the pneumatic seal is maintained.

In an alternative embodiment, a plurality of face seals are provided over the surface of the subcarrier either to provide additional support for larger diameter wafers during non polishing operations, or to define separate pressure zones. When separate pressure zones are provided, a separate source of pneumatic pressure is supplied to each zone in the manner described.

#2. Embodiment in Which a Controlled Air Pressure is Applied to the Retaining Ring, Sub-Carrier, Inner Tube and Back Side of Wafer Separately.

Figure 7:
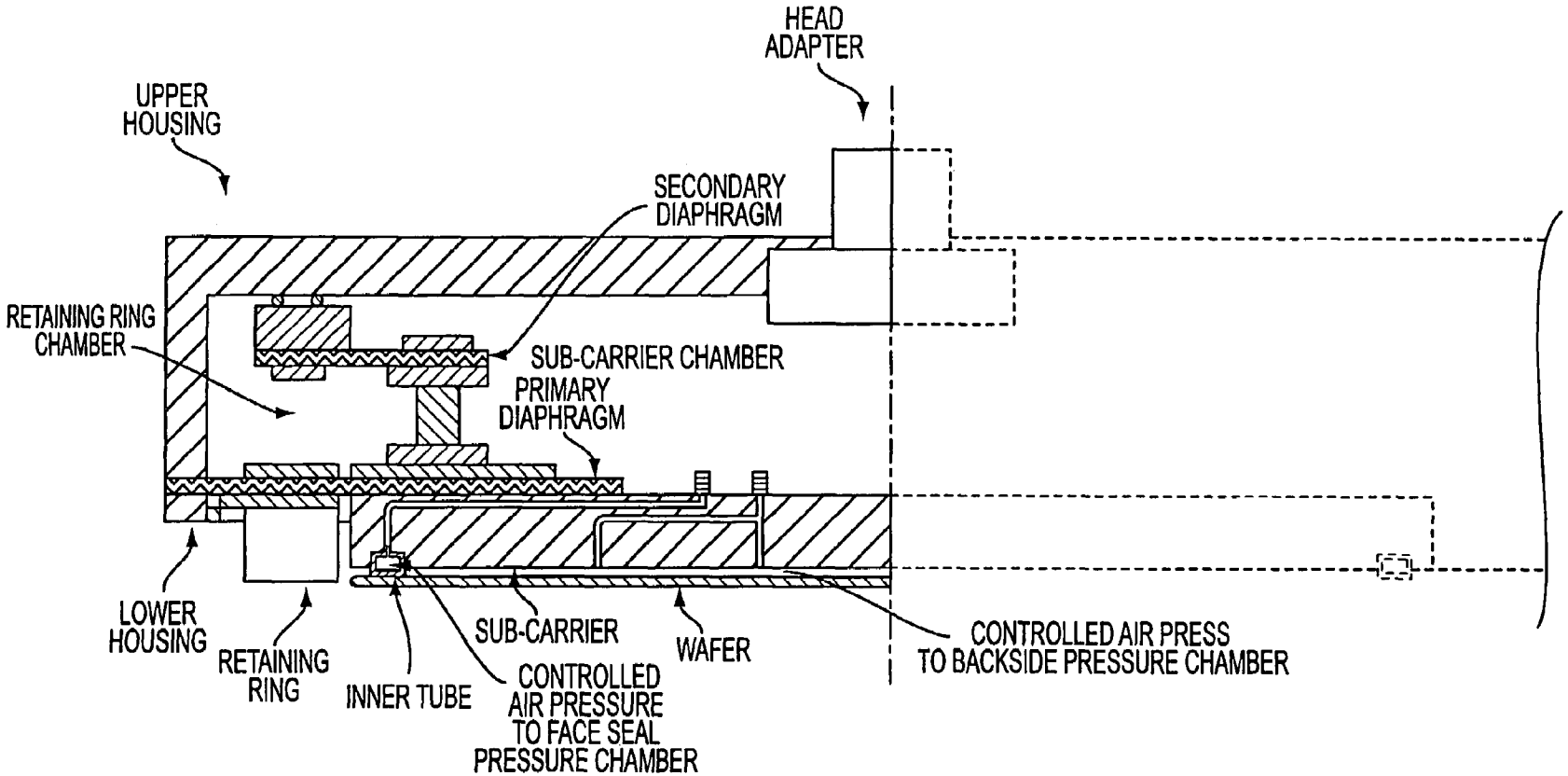
FIG. 7 is a diagrammatic illustration showing a second primary embodiment of the invention.

With respect to FIG. 7, there is shown a second primary embodiment of the invention. In this alternative embodiment, the face seal is modified to provide an additional face seal pressure chamber which receives the same or a different pressure from the same or a different source of pressurized fluid. As face pressure chamber is a closed chamber not open to the external world, liquids or gasses may be used as the pressure source. Normally, face seal pressure chamber will be coupled to a different source of pressurized fluid than backside pressure chamber as it is desirable to control each pressure separately for the reasons described below.

In conventional polishing systems, some variation in polishing may frequently be encountered near the peripheral edge of a wafer. Even in the embodiments of the invention providing a backside pressure chamber but having an inert or passive face seal, some (minimal) edge effects may occur. The potential for edge effects resulting from either the presence of the passive face seal or from other properties of the wafer, wafer polishing head, or wafer polishing method may be further reduced by providing a modified face seal that is an active face seal structure defining a face seal pressure chamber.

Active face seal differs from passive face seal at least in that the former defines a pressure chamber in the form of a circular or annular inner tube or bladder disposed proximate the peripheral edge of the wafer in the manner already described relative to the passive face seal.

As the active face seal is necessarily a thicker structure than the passive face seal owing to the presence of the pressure chamber defined within it, the active face seal is desirably partially mounted into an annular groove or recess formed (such as by molding, casting, or machining) into the subcarrier. In one embodiment of the active face seal, a somewhat tubular structure is provided in which pressurized fluid (liquid or gas, but preferably gas) are introduced into the tubular structure by an appropriate fitting inserted into the tubular face seal from within the subcarrier. As with the backside pressure chamber, the pressure to the active face seal may be communicated from a fitting mounted to the upper surface of the subcarrier and communicated to the tubular active face seal by a channel or manifold of channels within the subcarrier.

In an alternative embodiment, the active face seal is not a tubular structure but rather comprises a resilient sheet of material, molded channel, or the like that forms the face seal pressure chamber only when attached to the subcarrier. While the attachment of such a sheet or channel structure may be somewhat more complex owing to the need to achieve a positive pressure seal where the seal meets the subcarrier and the need for substantial uniformity of pressure at the seal/wafer interface, it provides a greater range of options for shape and material. Composite materials may be used that would be difficult to achieve with a true closed tubular structure.

Operation of the polishing head with the active face seal and face seal pressure chamber is similar to that already described for operation of the passive seal embodiment, except that the pressure in the face seal pressure chamber is separately and independently controlled during polishing operation. Depending on the characteristics of the wafer to be polished and the characteristics of the polishing or planarization procedure, the same or different pressures may be applied to the face seal pressure chamber and the backside pressure chamber. Usually different pressures will be applied, and the face seal chamber pressure may be greater than or less than the backside chamber pressure. For example, for a nominal polishing pressure of 8 psi in the backside polishing chamber, the face seal polishing chamber may utilize a pressure of 7 psi to 9 psi. Of course, the pressure in each of the face seal chamber and the backside chamber may be altered independently during the polishing operation.

#3. Embodiment in Which a Diaphragm Supports the Wafer from Floating Retaining Ring.

Figure 8:
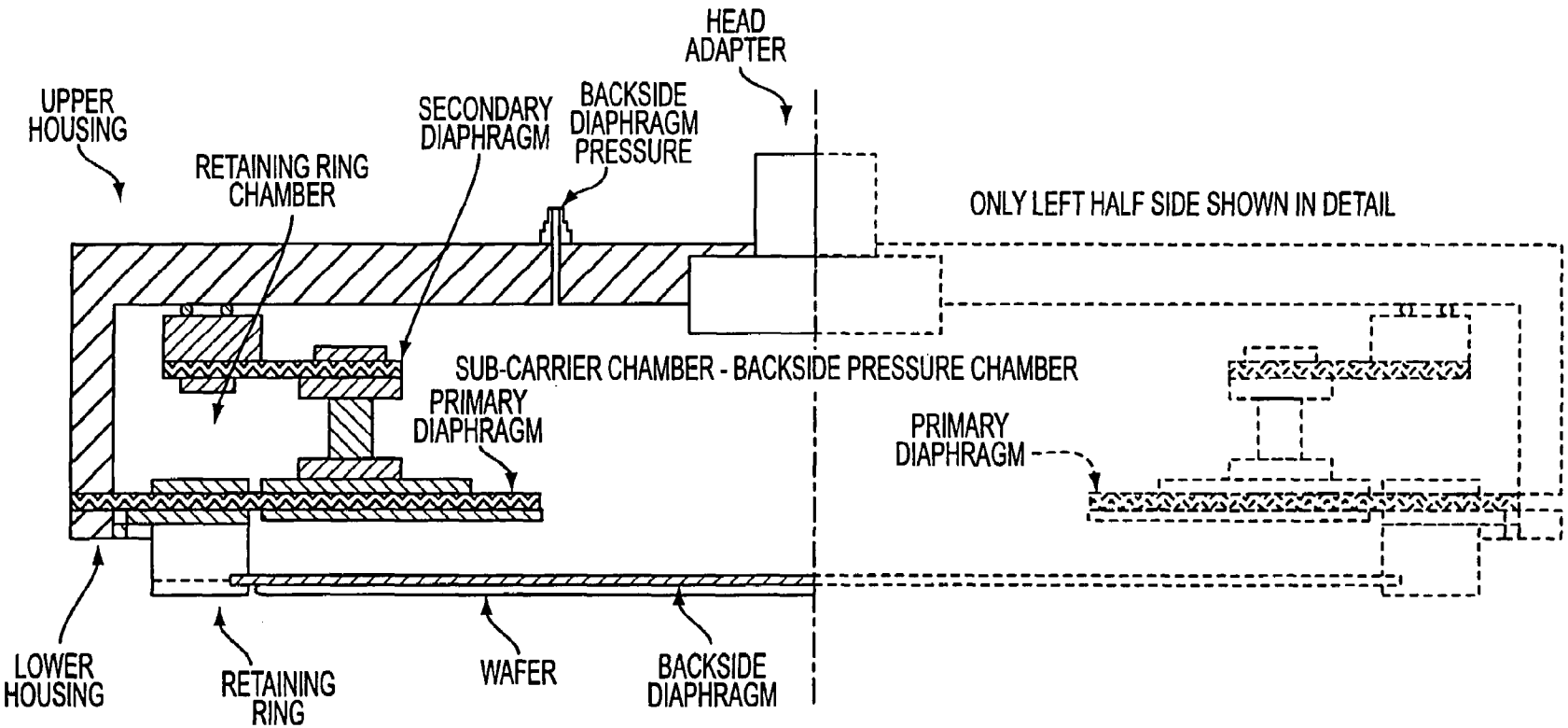
FIG. 8 is a diagrammatic illustration showing a third primary embodiment of the invention.

With respect to FIG. 8, there is shown a third primary embodiment of the invention. In this third primary embodiment, the conventional type subcarrier is eliminated entirely and a backside diaphragm or backside membrane is provided in its place to mount and support the semiconductor wafer or other substrate. This embodiment is advantageously implemented in conjunction with a movable or floating retaining ring as in the preferred embodiment, the wafer backside diaphragm is mounted directly to an inner cylindrical surface of the retaining ring. In one embodiment, the backside diaphragm has a circular shape and extends from the interior cylindrical surface of the retaining ring to span the retaining ring and form a pocket for receiving the semiconductor wafer or other substrate. As it is desirable during polishing that the surface of the retaining ring that contacts the polishing pad and the front side surface of the semiconductor wafer be coplanar or substantially coplanar during polishing, the depth of the pocket formed by the retaining ring and the backside diaphragm and the wafer be adjusted such that substantial coplanarity be achieved. Normally, where some variation in thickness of the wafer or other substrate is anticipated, or to account for long term ware of the contacting surface of the retaining ring, the pocket should be somewhat deeper than the nominal thickness of the wafers, as the resiliency of the backside wafer diaphragm and the backside diaphragm pressure applied against an inner surface of the backside diaphragm and communicated to the backside of the wafer through the backside diaphragm material are sufficient to accommodate a range of wafer thicknesses.

It is noted that in the illustration, the retaining ring appears to be formed as a solid structure and the backside wafer diaphragm is attached to the retaining ring by inserting the diaphragm into a groove or recess machined into the inner cylindrical surface of the retaining ring. While a retaining ring having this structure may be used, preferably a retaining ring having a removable and replaceable wear surface, where the retaining ring contacts the polishing pad. This permits the retaining ring wear surface to be replaced after a predetermined amount of wear so that the desired pocket depth range may be maintained. Wear indicators such as a limited number of depressions, pits, notches, or the like mechanical features that are visible during the useful life of the retaining ring wear surface and disappear after the useful life has expired. These mechanical wear indicators should be small enough that they do not create detectable pressure or polishing differences in different regions of the polishing head.

One exemplary structure for a retaining ring having a replaceable wear surface and other features is described in copending U.S. patent application Ser. No. 09/261,112 filed 3 Mar. 1999 and entitled Chemical Mechanical Polishing Head Assembly Having Floating Wafer Carrier and Retaining Ring, which is hereby incorporated by reference.

The polishing pressure is provided from a subcarrier chamber (SC chamber) directly against the inner surface of the backside diaphragm and communicated to the backside of the wafer through the diaphragm material. This subcarrier chamber pressure, more correctly characterized as backside diaphragm pressure is communicated to the backside diaphragm by a fitting in the housing that is in fluid communication with a cavity internal to the polishing head housing which is closed by the backside diaphragm.

The backside diaphragm should be as thin as possible consistent with the structural and lifetime requirements. More particularly, a thin backside diaphragm thickness is desirable because a thinner backside diaphragm more easily accommodates the presence of impurities on the backside surface of the wafer and provides a pressure that is more nearly like direct pneumatic pressure. On the other hand, a thicker backside diaphragm may typically have a longer lifetime, be less subject to failure during use, and be more securely attached to the retaining ring. Usually backside diaphragms made from rubber or other polymeric materials are advantageously used. Composite materials, such as materials incorporating strengthening fibers, may be used for the backside diaphragm; however, it is desirable that portions of the backside diaphragm act somewhat independently of other parts so maintaining sufficient resiliency is advantageous. Typically, backside diaphragms having a thickness between about 0.1 mm and about 4 mm may be used, though thinner and thicker diaphragms may be employed. More usually, backside diaphragms having a thickness between about 0.5 mm and about 2 mm may be used. Usually, the backside diaphragm will have a constant thickness.

In one alternative embodiment, a relatively thin backside diaphragm is stretched across the retaining ring in the manner of a taught drum. In yet another alternative embodiment, the thickness profile of the backside diaphragm varies as a function of radial position, being thicker in the region of attachment to the retaining ring and being thinner toward the center. When such thickness variation is provided, it is important that the surface presented to and in contact with the backside wafer surface is flat or nearly flat so that no polishing pressure variations are introduced.

In operation, a wafer or other substrate is placed in the pocket formed by the portion of the retaining ring cylindrical surface which extends from the outer surface of backside diaphragm and the backside diaphragm. Then the wafer and retaining ring are brought into contact with the polishing pad. A backside diaphragm polishing pressure is introduced into the backside chamber (subcarrier chamber) and presses against the inner surface of backside diaphragm. The pneumatic pressure is transferred through the material of the backside diaphragm and presses the on the backside of the wafer, which in turn forces the front side of the wafer against the polishing pad.

Advantageously, the backside diaphragm or membrane presses against the wafer and the polishing pressure is even distributed over its surface. For a thin backside diaphragm, the diaphragm acts more in the manner of a contamination shield to prevent water, polishing, slurry, or polishing debris from entering the interior of the head housing, and less like a structural element. In some embodiments, the backside diaphragm is very thin and acts in the manner of a thin bladder or balloon, to conform to the flat surface of the wafer without itself exerting any force other than the uniform force of the backside diaphragm chamber pressure.

#4. Embodiment in Which an Open Partial Annular Diaphragm Supports the Wafer from a Floating Retaining Ring.

Figure 9:
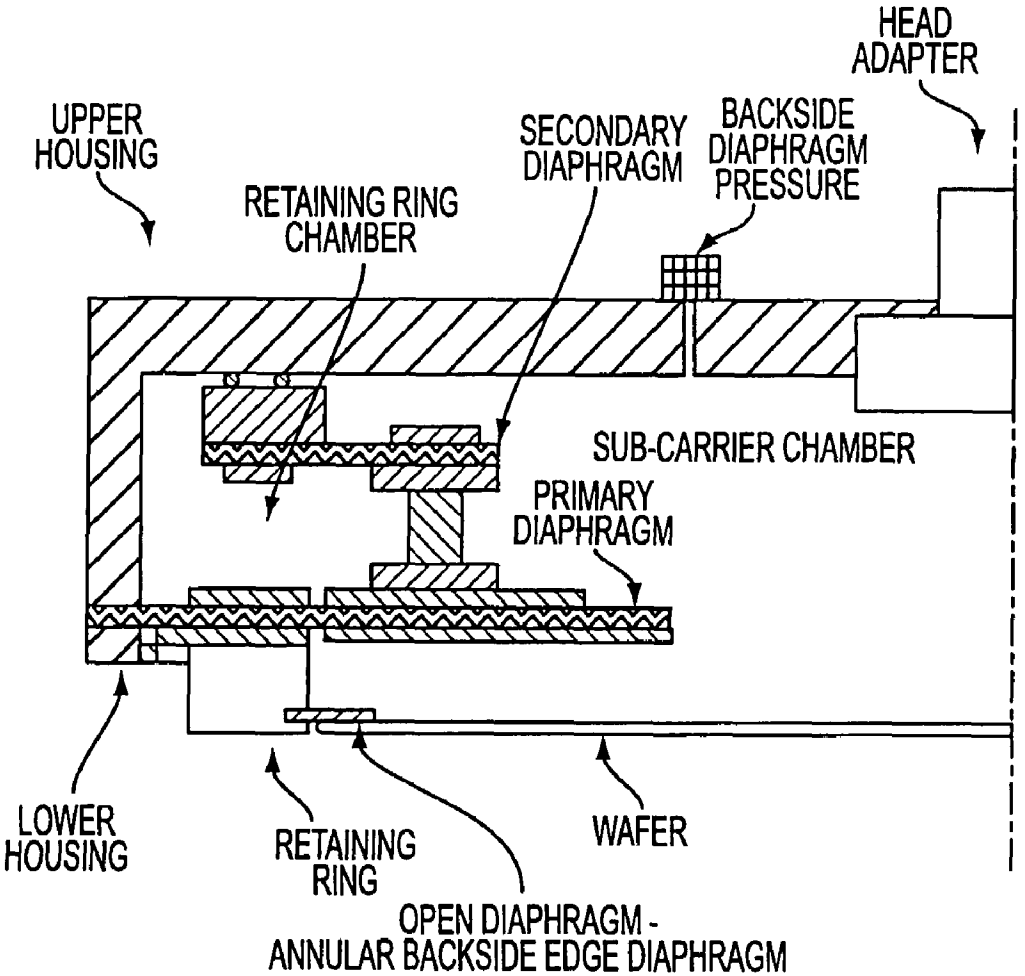
FIG. 9 is a diagrammatic illustration showing a fourth primary embodiment of the invention.

With respect to FIG. 9, there is shown a fourth primary embodiment of the invention. In this fourth primary embodiment of the invention, the backside diaphragm the structure and inventive concept of the backside diaphragm are modified to eliminate even the possibility of the backside diaphragm physical structure producing any nonuniform polishing effects or pressure profile deviations. In this embodiment, an open diaphragm extending only a short distance radially inward from the retaining ring is used. In simple terms, the full circular backside diaphragm of the previous embodiment is replaced by an annular backside edge diaphragm that seals off the backside pressure chamber when it is pressed against an outer peripheral radial portion of the wafer backside.

As the seal between the backside edge diaphragm and the backside wafer surface is responsible for creating the backside pressure chamber, the annular edge diaphragm may desirably be formed of a somewhat thicker and/or stiffer material than that of the afore described full circular backside diaphragm.

In one embodiment, the annular edge backside diaphragm extends substantially horizontally radially inward from the retaining ring, between about 3 mm and about 25 mm, but more typically between about 5 mm and about 10 mm. The annular backside diaphragm should extend a sufficient distance inward to guarantee a proper pressure seal, yet not extend so far that pressure profile variations are introduced by it. In particular, it is desirable to assure that the annular edge backside diaphragm does not create pressure profile or polishing discontinuity at its inner edge.

In another embodiment, the annular edge backside diaphragm may desirably extend downward slightly from its attachment on the retaining ring toward the wafer it will receive. In this manner, the annular diaphragm acts like a resilient spring where the contact pressure increases and the seal becomes tighter and the pressure in the chamber and the amount of contact increases. however, because of the pressure variation that may be introduce if a strong effective spring constant is used, this type of conically shaped resilient diaphragm should extend a more limited distance radially inward, such as for example only so far as the nominal edge exclusion region (about 3 mm to about 5 mm).

#5. Embodiment in Which a Pneumatic Tube or Pressure Bladder Supported from Floating Retaining Ring Mounts the Wafer.

Figure 10:
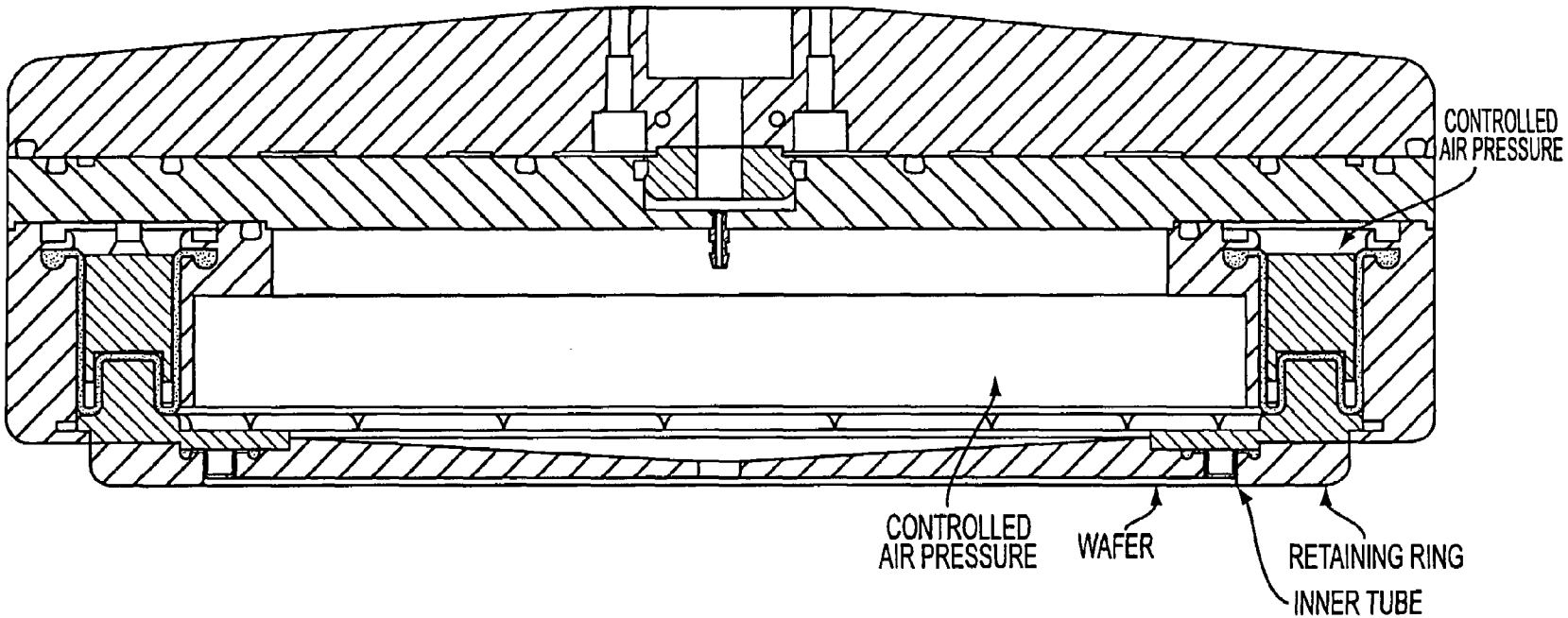
FIG. 10 is a diagrammatic illustration showing a fifth primary embodiment of the invention.

With respect to FIG. 10, there is shown a fifth primary embodiment of the invention. In one embodiment the wafer is carried by a resilient pneumatic annular sealing bladder, effectively a tubular bladder, supported from a retaining ring. The wafer polishing head includes a retaining ring having an interior cylindrical and defining an interior cylindrical pocket sized to carry the wafer to be polished and to laterally restrain movement of the wafer when the wafer is moved relative to the polishing pad. Relative movement may be a rotational movement of the head with attached wafer and a separate rotational movement of the polishing pad. Linear motor of the rotating head across the rotating pad may also be used.

A wafer attachment stop plate is attached to the retaining ring but in the preferred embodiment serves only as a mechanical stop to assist in holding the wafer under an applied vacuum holding pressure without excessive bowing or bending. In overly simple terms, a wafer attachment stop plate is analogous to a subcarrier except that the wafer attachment stop plate only assists operation during wafer loading and unloading. It does not carrier the wafer in any conventional sense, during polishing or planarizing operations.

Instead the wafer is carried by a tube like resilient pneumatic annular sealing bladder that is coupled for fluid communication to a first pressurized pneumatic fluid such as air or other gas. This resilient pneumatic annular sealing bladder defines a first pneumatic zone or chamber and is attached to a first surface of the wafer attachment stop plate adjacent to the retaining ring interior cylindrical surface to receive the wafer and to support the wafer at or near its peripheral edge. This resilient pneumatic annular sealing bladder also carries a pneumatic pressure that primarily acts upon the outer peripheral edge portion (for example, acts on the outermost 0 mm to 3 mm portion out to the outermost 10 mm radial portion).

The resilient pneumatic annular sealing bladder also defines a second pneumatic zone or chamber radially interior to the first pneumatic zone or chamber and extending between the first (outer) surface of the wafer stop plate and an attached wafer when the a wafer is attached to the polishing head during a polishing operation. The second pneumatic zone or chamber is coupled for fluid communication to a second pressurized pneumatic fluid. In one embodiment, the second chamber is a thin plate like chamber extending between the back side surface of the wafer, the outer surface of the attachment stop plate, and the seal formed by the resilient pneumatic annular sealing bladder. The second pressurized pneumatic fluid is communicated to the second zone or chamber via a hole (or holes) extending through the attachment stop plate to a plenum chamber within the housing. This plenum chamber is usually communicated to the chamber via fittings and tubing to an external source of pressurized pneumatic fluid. One or more rotary unions such as are known in the art may be used. One exemplary rotary union is described in U.S. Pat. No. 5,443,416 entitled Rotary Union for Coupling Fluids in a Wafer Polishing Apparatus by Volodarsky et al, assigned to Mitsubishi Materials Corporation, and hereby incorporated by reference It is noted that the first or outer surface of the wafer attachment stop plate does not contact the wafer back side surface during polishing of the wafer, and preferably does not contact the wafer during wafer load and unload operations (though it may so contact). The wafer attachment stop plate primarily being operative during non polishing periods to prevent the wafer from flexing excessively from an applied vacuum force used to hold the wafer to the polishing head during wafer loading and unloading operations. It also assists in minimizing the introduction of polishing slurry or polishing debris into the housing. The first and the pressurized fluids are adjusted to achieve a predetermined polishing pressures over a front side surface of the wafer. The first pressurized fluid being applied to the interior of the resilient pneumatic annular sealing bladder is coupled to the bladder from an external force via fittings, tubing, and the rotary union or other conventional manner. The first chamber exerts its force primarily at or near the peripheral edge of the wafer. The second chamber exerts its pneumatic force over the remaining central area of the wafer and provided the predominant polishing pressure. The edge bladder may be seen as providing a differential pressure to alter the edge polishing characteristic.

Just prior to beginning a polishing operation, the back side surface of a substrate, such as a semiconductor wafer, is placed against the resilient pneumatic annular sealing bladder. The resilient pneumatic annular sealing bladder may be attached to the retaining ring in various ways. For example, in one embodiment the resilient pneumatic annular sealing bladder is bonded to the subcarrier. In another embodiment, a grooved channel is provided in the downward facing face of the retaining ring to receive the resilient pneumatic annular sealing bladder. In another embodiment, the resilient pneumatic annular sealing bladder is formed by confining an annular shaped portion of sheet like or molded material into a loop and confining the loop with fasteners onto interior surfaces associated with the retaining ring. The fasteners are covered by a retaining ring wear surface member and the afore described wafer attachment stop plate so that only a portion of the sealing bladder extends above the surface of the attachment stop plate. The portion which extends separates the wafer from the stop plate.

Independent of how the resilient pneumatic annular sealing bladder is attached to the retaining ring (or the subcarrier), the resilient pneumatic annular sealing bladder should be sized and attached in such manner that a lower surface portion of the resilient pneumatic annular sealing bladder extends above the attachment stop plate surface so that when a semiconductor wafer is mounted, a backside pocket or back side pneumatic chamber is created between the back side of the wafer and the downward facing surface of the wafer attachment stop plate. The amount of extension or pocket depth should be such that when the semiconductor wafer is mounted onto the resilient pneumatic annular sealing bladder, the wafer desirably does not contact the attachment stop plate either (i) when a vacuum is applied to hold the wafer to the resilient pneumatic annular sealing bladder immediately before and immediately after polishing, or (ii) when a polishing pressure is applied in the backside pneumatic chamber and the wafer is pressed against the polishing pad. Occasional contact is acceptable though undesirable and the primary reason for providing the attachment stop plate is to prevent excessive bowing that may cause cracking, breaking, or excess strain to develop within the wafer or other substrate. The actual pocket depth depends on several factors, including the material from which the resilient pneumatic annular sealing bladder is fabricated and the amount of pressure that will be introduced into the bladder, the diameter of the substrate or wafer being held in that a larger substrate may be expected to bow inward (toward the subcarrier) when a holding vacuum is applied and to be pressed inward (particularly in the center of the wafer where less support is provided by the resilient pneumatic annular sealing bladder itself) than a smaller substrate, and the range of vacuum and positive polishing pressures applied to the bladder, among other factors. Pocket depths between about 0.5 mm and about 5 mm may be used, but a pocket depth of between about 1 mm and about 2 mm are typical for a 200 mm wafer polishing head. Larger pocket depths may be used for larger wafers, such as for example 300 mm wafers where the amount of acceptable bowing at the center of the wafer may be greater than for a 200 mm diameter wafer.

The vacuum (negative pressure) holding force and the positive polishing pressure are provided into the second chamber from at least one hole at the downward facing surface of the attachment stop plate that is in fluid communication with a source of pressurized fluid. Pressurized gas, usually air, from a source of pressurized air may advantageously be used. A plurality of such holes or orifices may optionally be provided at the attachment stop plate surface, and may be advantageous for quickly and uniformly changing the pressure on the wafer backside. In like manner, the source of vacuum may be communicated via the same holes or via different holes. Typically, the pressurized gas is communicated to the holes or orifices by attaching a fitting to the upper side of attachment stop plate or by providing the pressure directly into a plenum chamber within the housing and providing holes, channels, or other openings between the second chamber and the interior housing plenum chamber. It is noted that as the orifices or holes through the attachment stop surface are separated from the backside of the wafer by a space, polishing is not sensitive to the location or size of the orifices as compared to conventional polishing heads in which the orifices contact the wafer directly or through a polymeric insert.

In operation a wafer is positioned in the pocket formed by the retaining ring which extends slightly beyond the lower surface of the resilient pneumatic annular sealing bladder during a wafer loading operation, and is held in place against the bladder by a vacuum. The polishing head, including the retaining ring, resilient pneumatic annular sealing bladder, attachment stop plate, and attached wafer are then positioned in opposition against the polishing pad. Usually, both the polishing head and the polishing pad are moved in an absolute sense but certainly relative to each other so that uniform polishing and planarization are achieved.

The inventive structure applies pressure directly against the backside of the wafer (except where the resilient pneumatic annular sealing bladder is located) so that localized pressure variations such as might result from variation in the properties of the polishing insert, occurrence of contaminants between the wafer backside and the insert or subcarrier face, non-flatness of the insert or subcarrier surface, or the like present in conventional system do not occur. As some pressure variation may possibly occur as a result of the presence of the resilient pneumatic annular sealing bladder, the resilient pneumatic annular sealing bladder is desirably located proximate the peripheral edge of the wafer in the so called edge exclusion region, and be only so wide (the difference between the annular inner radius and the annular outer radius) to provide a reliable seal. Usually a width of from about 2 mm to about 10 mm may be used, more typically a width of between about 3 mm and about 6 mm, but lesser or greater widths may be employed. Note that when a pure pneumatic pressure is applied to the backside polishing chamber, the downward polishing pressure is uniform independent of any contaminants that may be present on the wafer backside. Thus more uniform polishing is provided.

Although we have shown and described what appears to be a structure for the attachment stop plate having some generic resemblance to a subcarrier, this is not actually the case, and it is noted that the particular characteristics of the attachment stop plate are not important as it does not actually mount the wafer and is not responsible for presenting a flat or planar surface against which the wafer mounts, directly or through an insert. For example, the surface of the attachment stop plate may be non-planar so long as the resilient pneumatic annular sealing bladder is mounted in such manner that its contacting surface is sufficiently planar so that the pneumatic seal is maintained. In one embodiment the outer surface of the attachment stop plate is angled somewhat inward toward the center so that some what greater bowing is permitted in the center of the wafer without touching the wafer attachment stop plate.

By way of summary, this particular embodiment of the invention provides a wafer polishing head for polishing a semiconductor wafer on a polishing pad, where the polishing head includes a retaining ring having an interior cylindrical surface and defining an interior cylindrical pocket sized to carry the wafer and to laterally restrain movement of the wafer when the wafer is moved relative to the polishing pad while being polished against the polishing pad; a wafer attachment stop plate attached to the retaining ring; and a resilient pneumatic annular sealing bladder coupled for fluid communication to a first pressurized pneumatic fluid to define a first pneumatic zone and attached to a first surface of the wafer stop plate adjacent the retaining ring interior cylindrical surface to receive the wafer and to support the wafer at a peripheral edge. The resilient pneumatic annular sealing bladder defining a second pneumatic zone radially interior to the first pneumatic zone and extending between the first surface of the wafer stop plate and the wafer when the wafer is attached to the polishing head during a polishing operation and coupled for fluid communication to a second pressurized pneumatic fluid, the first surface of the wafer stop plate not being in contact with a wafer back side surface during polishing of the wafer. The wafer attachment stop plate is operative during non polishing periods to prevent the wafer from flexing excessively from an applied vacuum force used to hold the wafer to the polishing head during wafer loading and unloading operations; and the first and the second pressurized fluids being adjusted to achieve a predetermined polishing pressures over a front side surface of the wafer.

#6. Embodiment having Lip Seal Supported from Floating Retaining Ring.

Figure 11:
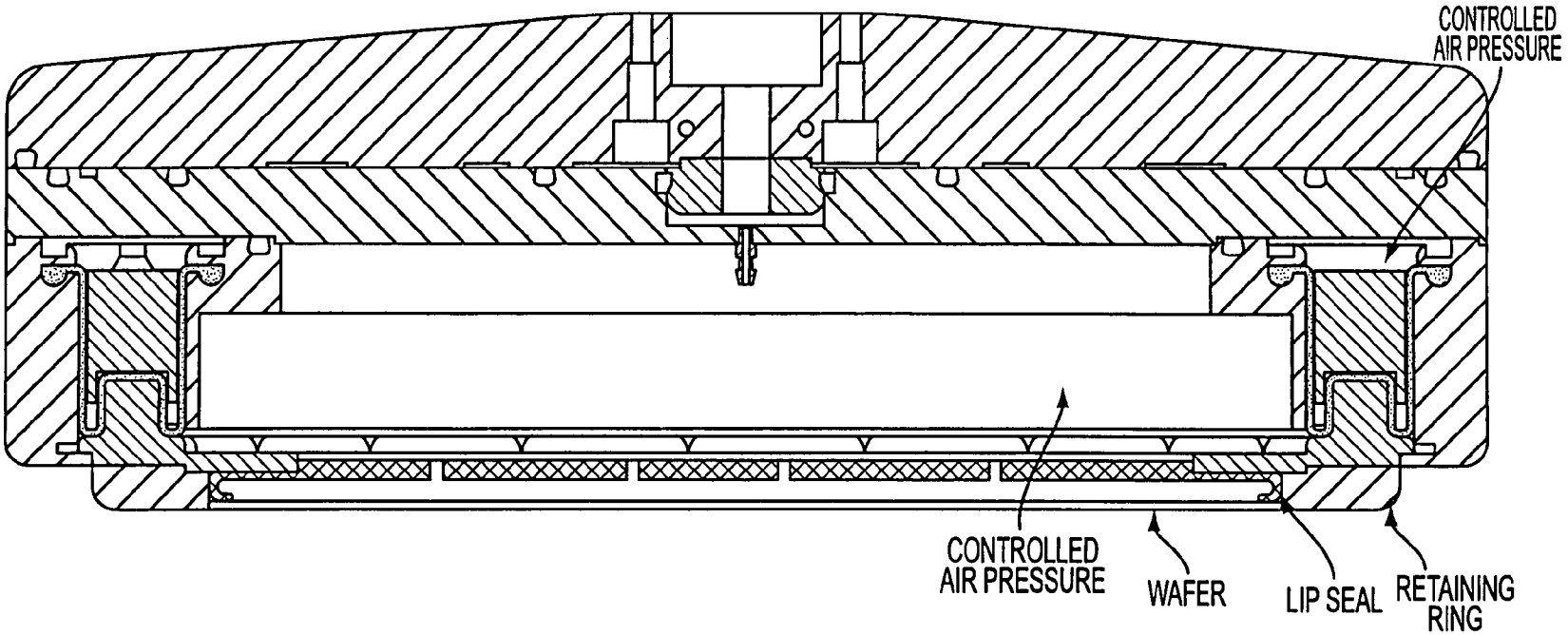
FIG. 11 is a diagrammatic illustration showing a sixth primary embodiment of the invention.

With respect to FIG. 11, there is shown a sixth primary embodiment of the invention. Having now described the structure and operation of an embodiment having a resilient pneumatic annular sealing bladder that provides a separate pressure chamber for controlling the pneumatic (or hydraulic) pressure at the peripheral edge of a substrate, we now turn our attention to the description of an alternative embodiment in which the resilient pneumatic annular sealing bladder is replaced by a resilient lip seal. In this embodiment, the separate chamber that provides a controllable and adjustable pressure to the edge of the wafer is eliminated in favor of a simpler and less expensive design.

A resilient seal is disposed adjacent to the retaining ring interior cylindrical surface to receive the wafer and to support the wafer at a backside peripheral edge surface. The resilient face seal defining a pneumatic zone when a wafer or other substrate has been mounted to it. The pneumatic pressure zone is comparable to that described for the embodiment having the resilient pneumatic annular sealing bladder, and is coupled for fluid communication to a pressurized pneumatic fluid in like manner.

The resilient seal may advantageously be provided as a portion of a wafer stop plate or as a separate element disposed between an outside face of the wafer stop plate and the backside of a mounted wafer.

The resilient face seal is flexible in order to allow some vertical travel or movement of wafer, and creates a pressure seal between the backside surface of the wafer, the inner cylindrical surface of the retaining ring, and the pneumatic pressure chamber. In one embodiment, the face seal is formed as an extension of a polymeric wafer stop plate. In cross section, the extension has the form of a finger extending outward from the outer surface of the wafer stop plate to make contact with the wafer. This extension "finger" in fact a circular (or annular) ridge having a somewhat conical shape and has the property that as the contact pressure between the face seal and the wafer increases, either as a result of increased pressing force of the wafer against the face seal or as a result of the increased pneumatic pressure applied within the pressure chamber, the strength of the seal is increased.

In one embodiment of the invention, the pneumatic pressure within the pressure chamber is communicated to the chamber via one or more holes or orifices extending between the pressure chamber and a plenum chamber within the housing. In an alternative embodiment, one or more fittings are attached to the inner surface of the Wafer stop plate where tubing is attached and connected to an external source of pressurized gas. The pressurized gas is then communicated to the pressure chamber via holes or channels through the wafer stop plate.

The wafer stop plate has the same function as in the afore described embodiment. The wafer attachment stop plate operative during non polishing periods to prevent the wafer from flexing excessively from an applied vacuum force used to hold the wafer to the polishing head during wafer loading and unloading operations. Therefore the same or a similar structure may be used except that when an integral face seal is used, the material from which the wafer stop plate and integral face seal is formed should have the desired flexibility and resiliency to form a proper seal. Many polymeric materials have such properties, and the thickness of the stop plate main body portion and the seal portion may be adjusted to provide the desired stiffness of the main body portion and the desired resiliency in the seal portion. The vacuum force may be applied through the same holes or channels as the positive pressing force.

By way of summary, the present embodiment provides a wafer polishing head for polishing a semiconductor wafer or other substrate on a polishing pad, where the polishing head includes a retaining ring having an interior cylindrical surface and defining an interior cylindrical pocket sized to carry the wafer and to laterally restrain movement of the wafer when the wafer is moved relative to the polishing pad while being polished against the polishing pad; a wafer attachment stop plate attached to the retaining ring; and a resilient seal disposed adjacent the retaining ring interior cylindrical surface to receive the wafer and to support the wafer at a peripheral edge and defining a first pneumatic zone when the wafer has been mounted coupled for fluid communication to a first pressurized pneumatic fluid. The wafer attachment stop plate is operative during non polishing periods to prevent the wafer from flexing excessively from an applied vacuum force used to hold the wafer to the polishing head during wafer loading and unloading operations; and the pressurized fluids may be independently adjusted to achieve a predetermined polishing pressures over a front side surface of the wafer.

#7. Embodiment having Plurality of Pressure Tubes or Bladders for Controlling Multiple Pressure Zones on Wafer.

Figure 12:
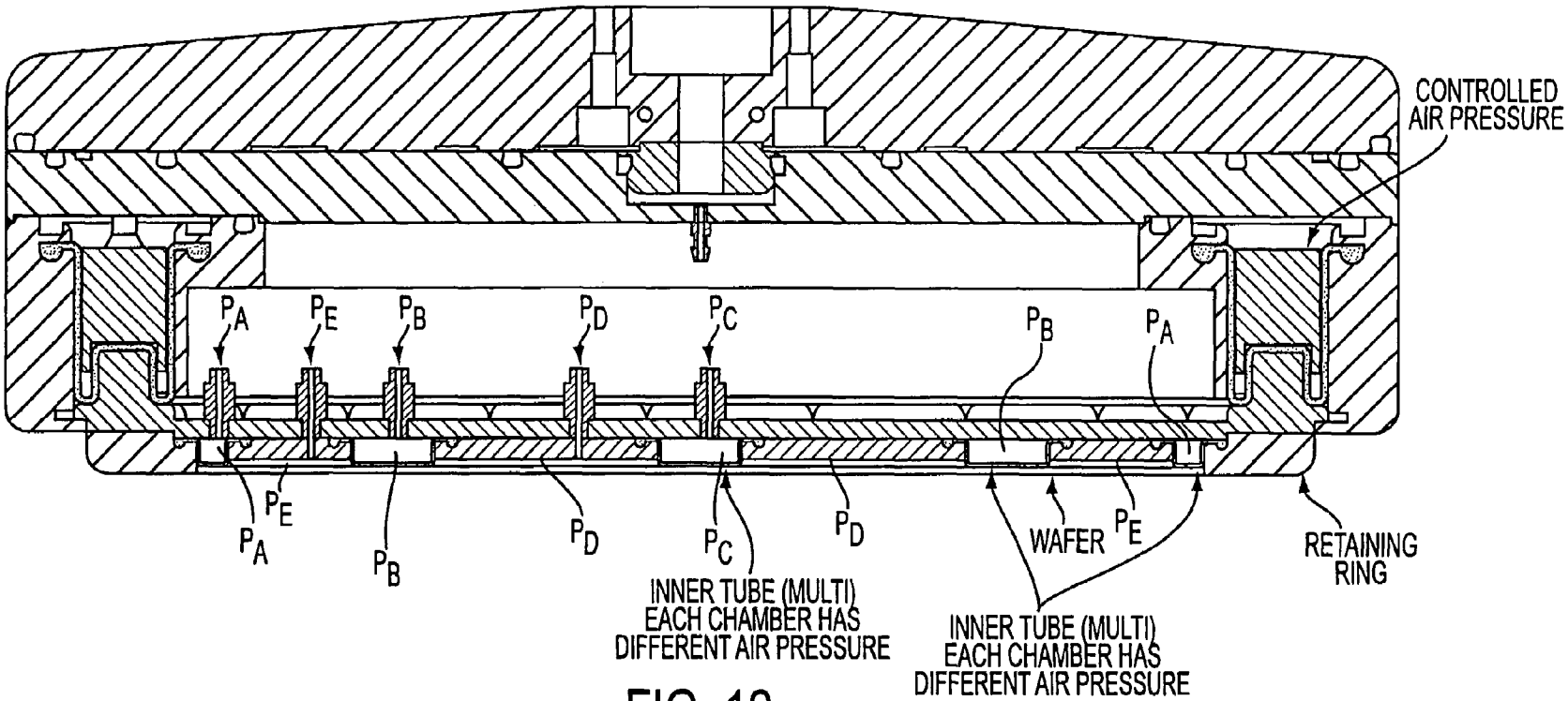
FIG. 12 is a diagrammatic illustration showing a seventh primary embodiment of the invention.

With respect to FIG. 12, there is shown a seventh primary embodiment of the invention. In this seventh primary embodiment, the concept, structure, and method of the embodiment having the single peripheral edge resilient pneumatic annular sealing bladder is extended to provide a multi-pressure chamber structure on the backside of the wafer. In this embodiment, the wafer is carried by a plurality of pneumatic bladders supported from the lower portion of the polishing head. Effectively, they are supported or suspended from the retaining ring by a circular bladder attachment plate that extends across the opening in the retaining ring in the manner of a wafer carrier or subcarrier; however, it is to be appreciated that the analogy with a wafer carrier or subcarrier is inaccurate since the wafer does not contact the carrier and the circular bladder attachment plate moves with the retaining ring in the preferred embodiment of the invention.

In the embodiment illustrated in the figure, three separate bladders are provided. A first resilient pneumatic annular sealing bladder, effectively a tubular bladder, supported from the retaining ring and located at the peripheral edge of the wafer adjacent the inner cylindrical surface of the retaining ring, a second pneumatic bladder in the form of a round or disk for applying polishing pressure to a central portion of the wafer, and a third bladder in the form of an annular bladder that is located intermediate between the first annular bladder and the central disk bladder. It is noted that other arrangements of annular bladders may be provided, that the central disk shaped bladder may not be present, and that any number of bladders may be provided. In addition, the bladders may be abutted or nearly abutted so as to form an annular array of closely spaced pressure chambers for providing a pressing force directly on the backside of the wafer.

Pneumatic pressure to the first peripheral edge annular bladder ($P_A$), to the central bladder ($P_C$), and to the intermediate bladder ($P_B$) are provided to tubes or other conduits to separate fittings attached to the inside surface of the wafer stop plate and communicated through the fittings and holes or channels in the stop plate to an interior of each bladder.

Each of the three bladders also defines or helps to define two additional chambers disposed between the bladders. For example, a fourth pressure chamber ($P_D$) is defined between the central bladder and the intermediate bladder, and a fifth pressure chamber ($P_E$) is defined between the first peripheral edge bladder and the intermediate annular bladder. Each of these fourth and fifth chambers is also provided with pressurized gas, as well as optionally with a vacuum for loading and unloading operations.

It is noted that in this embodiment each of the pressures ($_{PA}$, $_{PB}$, $P_C$, $P_D$, $P_E$) may be independently controlled thereby allowing for fine control of the polishing pressure profile. These pressures may optionally be varied under the control of a computer control system to vary the pressure in one or more chambers during the polishing operation. Feedback from a process monitor may be used to adjust the pressures in each chamber (each bladder or each inter-bladder chamber) to achieve the desired polishing result.

Although we have described separate sources for each of the pressures, in one embodiment, a single source feeds pressurized gas to a manifold, and the manifold has a plurality of adjustable outputs, each output directed to a different chamber. In this manner, the burden of communicating multiple pressures from a stationary external source to the rotating head, such as by using a rotary union, is reduced.

As in the earlier described embodiment having only a single annular pneumatic bladder, the wafer polishing head includes a retaining ring having an interior cylindrical wall surface and defining an interior cylindrical pocket sized to carry the wafer to be polished and to laterally restrain movement of the wafer when the wafer is moved relative to the polishing pad. Relative movement may be a rotational movement of the head with attached wafer and a separate rotational movement of the polishing pad. Linear motor of the rotating head across the rotating pad may also be used.

As described, the wafer attachment stop plate is attached to the retaining ring and in principle continues to serve somewhat the function of a mechanical stop to assist in holding the wafer under an applied vacuum holding pressure without excessive bowing or bending; however, in this embodiment the wafer attachment stop plate function is somewhat diminished when many bladders are disposed over its surface, as the bladders themselves control the amount of bowing of the wafer when they are pressurized.

The annular widths or diameter, the location of the annular ring or disk, and the pressure applied are adjusted to achieve the desired polishing result. As in the earlier described embodiment, the first pneumatic annular sealing bladder disposes at or near the peripheral edge of the wafer carries a pneumatic pressure that primarily acts upon the outer peripheral edge portion (for example, acts on the outermost 0 mm to 3 mm portion out to the outermost 10 mm radial portion). The width of the other bladders, and inter-bladder chambers may be freely selected and may for example include thin (e.g. 2-5 mm wide annular bladders) or wider annular bladders (e.g. 5-25 mm wide bladders).

In one embodiment, where closely packed bladders are provided, the inter-bladder chambers are not separately pressurized (except for a common vacuum holding force during loading and unloading) and the polishing pressure is provided by the bladders. Venting is also provided from the inter-bladder regions to prevent any pressure buildup in the non-pressurized regions.

Each of the resilient pneumatic bladders may be attached to the retaining ring (or retaining ring and stop plate) in various ways. For example, in one embodiment the bladder is bonded to the retaining ring/plate structure. In another embodiment, a grooved channels are provided in the downward facing face to receive the bladders. In another embodiment, the pneumatic bladders are formed by confining an annular shaped portion (or round disk) of sheet like or molded material into a loop and confining the loop with fasteners onto interior surfaces associated with the retaining ring. The fasteners are covered by a retaining ring wear surface member or by annular spacer rings disposed between the annular or disk bladders so that only a portion of the bladders extends above the surface of the attachment stop plate. This is the configuration illustrated in the figure. The portion which extends above the annular spacer rings separate the wafer from the stop plate and ultimately serve as the stop plate.

Independent of how the resilient pneumatic annular sealing bladder is attached to the retaining ring (or the subcarrier), the bladders should be sized and attached in such manner that a lower surface portion of the bladder extends above the attachment stop plate surface so that when a semiconductor wafer is mounted, a backside pocket or back side pneumatic chamber is created between the back side of the wafer and the downward facing surface of the wafer attachment stop plate. The amount of extension or pocket depth should be such that when the semiconductor wafer is mounted onto the resilient pneumatic annular sealing bladder, the wafer desirably does not contact the attachment stop plate (or the annular extension blocks) either (i) when a vacuum is applied to hold the wafer to the bladder immediately before and immediately after polishing, or (ii) when a polishing pressure is applied and the wafer is pressed against the polishing pad. Occasional contact is acceptable though undesirable and the primary reason for providing the attachment stop plate is to prevent excessive bowing that may cause cracking, breaking, or excess strain to develop within the wafer or other substrate. The actual pocket depth depends on several factors, including the material from which the pneumatic bladder is fabricated and the amount of pressure that will be introduced into the bladder, the diameter of the substrate or wafer being held, and the range of vacuum and positive polishing pressures applied to the bladder, among other factors. Pocket depths between about 0.5 mm and about 5 mm may be used, but a pocket depth of between about 1 mm and about 2 mm are typical for a 200 mm wafer polishing head. Larger pocket depths may be used for larger wafers, such as for example 300 mm wafers where the amount of acceptable bowing at the center of the wafer may be greater than for a 200 mm diameter wafer.

The vacuum (negative pressure) holding force and the positive polishing pressure are provided into the inter-bladder chambers. The source of vacuum may be communicated via the same holes or via different holes as the pressurized gas. Typically, the pressurized gas is communicated to the holes or orifices by attaching a fitting to the upper side of attachment stop plate. It is noted that as the orifices or holes through the attachment stop surface are separated from the backside of the wafer by a space, polishing is not as sensitive to the location or size of the orifices as compared to conventional polishing heads in which the orifices contact the wafer directly or through a polymeric insert.

In operation a wafer is positioned in the pocket formed by the retaining ring which extends slightly beyond the lower surface of the resilient pneumatic annular sealing bladder during a wafer loading operation, and is held in place against the bladders by a vacuum. The polishing head, including the retaining ring, bladders, attachment stop plate, and attached wafer are then positioned in opposition against the polishing pad. Usually, both the polishing head and the polishing pad are moved in an absolute sense but certainly relative to each other so that uniform polishing and planarization are achieved.

The inventive structure applies pressure directly against the backside of the wafer (except where the bladders are located) so that localized pressure variations such as might result from variation in the properties of the polishing insert, occurrence of contaminants between the wafer backside and the insert or subcarrier face, non-flatness of the insert or subcarrier surface, or the like present in conventional system do not occur. While some processing variation may generally result from the presence of the bladders, judicious selection of the number of bladders, their position, and the pressure applied typically provides sufficient control that the polishing result is better than conventional systems.

By way of summary, in the present embodiment, there is provided a wafer polishing head for polishing a semiconductor wafer or other substrate on a polishing pad, where the polishing head includes a retaining ring having an interior cylindrical surface and defining an interior cylindrical pocket sized to carry the wafer and to laterally restrain movement of the wafer when the wafer is moved relative to the polishing pad while being polished against the polishing pad; a wafer attachment stop plate attached to the retaining ring; and a plurality of resilient pneumatic bladders attached to a first surface of the wafer stop plate, each the bladder being coupled for fluid communication to a source of pressurized pneumatic fluid. A first one of the plurality of resilient pneumatic bladders having an annular shape and disposed adjacent the retaining ring interior cylindrical surface to receive the wafer and to support the wafer at a peripheral edge, the first bladder being coupled for fluid communication to a first pressurized pneumatic fluid. A second one of the plurality of resilient pneumatic bladders disposed interior to the annular shaped first bladder and coupled for fluid communication to a second pressurized pneumatic fluid. The first and the pressurized fluids being adjusted to achieve a predetermined polishing pressures over a front side surface of the wafer.

#8. Embodiment having Plurality of Seal for Controlling Multiple Pressure Zones on Wafer.

Figure 13:
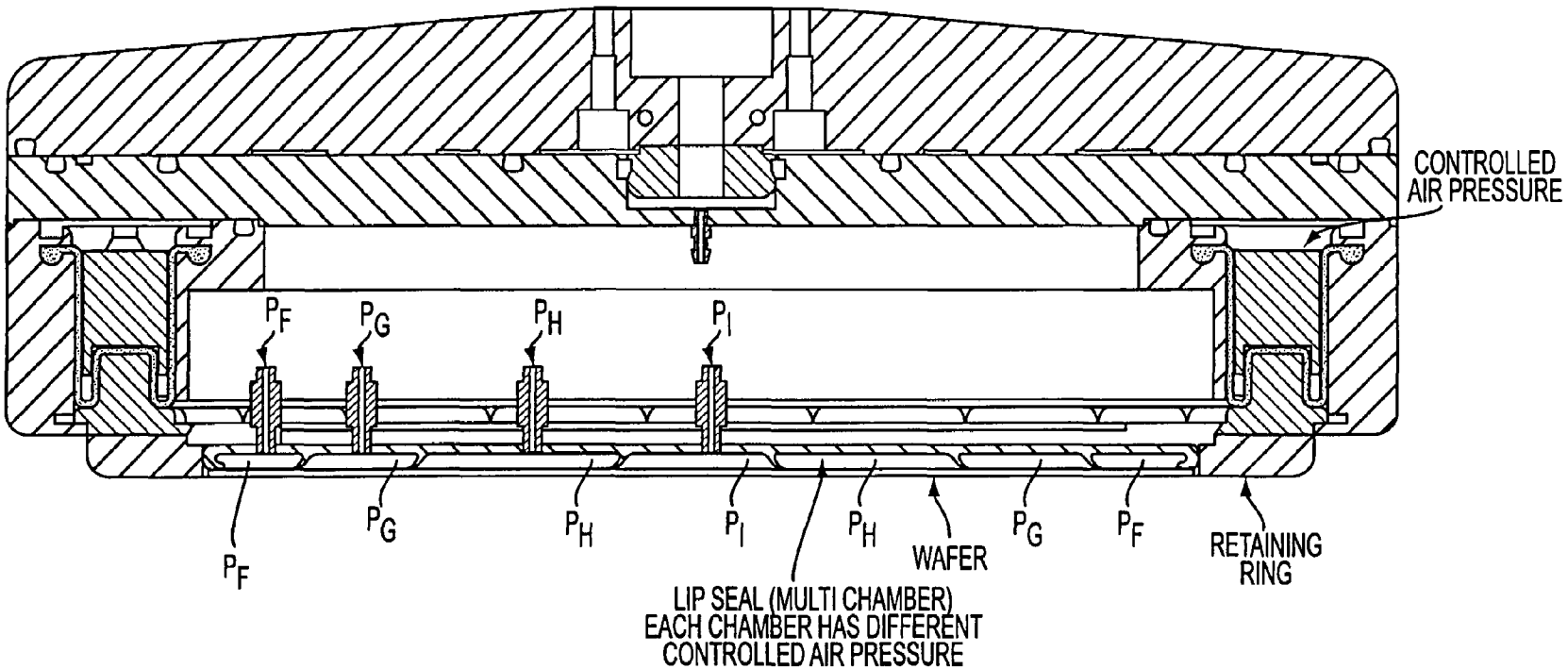
FIG. 13 is a diagrammatic illustration showing a eighth primary embodiment of the invention.

With respect to FIG. 13, there is shown an eighth primary embodiment of the invention. The inventive concept of providing a plurality of independent pressure chambers on the backside face of the wafer using a plurality of resilient pressure bladders and inter-bladder chambers may be modified and extended to a structure utilizing the afore described resilient face or lip type seal.

In the earlier described embodiment having a single resilient seal, the single resilient seals was disposed adjacent to the retaining ring interior cylindrical surface to receive the wafer and to support the wafer at a backside peripheral edge surface. The resilient face seal defined a single pneumatic zone when a wafer or other substrate has been mounted to it. The single pneumatic pressure zone was coupled for fluid communication to a pressurized pneumatic fluid such as a gas. In the embodiment described, the resilient seal was advantageously provided as a portion of a wafer stop plate or as a separate element disposed between an outside face of the wafer stop plate and the backside of a mounted wafer.

In the present embodiment, a plurality of annular resilient face seals are provided extending from the wafer stop plate. For example, in the illustrated embodiment, four annular seals are provided (①, ②, ③, ④) and define four separate pressure chambers ($P_F$, $P_G$, $P_H$, and $P_I$) on the backside surface of the wafer. Each chamber has a pressure that is introduced to it via a fitting attached to the inner surface of the stop plate and a hole or channel opening onto an orifice within the outer surface of the stop plate between ridge-like face seals. The pressures may be introduced via a rotary union from an external sources as is known in the art. The pressure in each chamber may be independently controlled to achieve the desired polishing performance. These pressures may be the same, or different, and may be varied during the polishing operation.

As for the single resilient face seal described earlier, each seal is desirably flexible in order to allow some vertical travel or movement of wafer, and permit creation of multiple leak-free pressure seals with the backside surface of the wafer. In one embodiment, the face seals are formed as extensions of the polymeric wafer stop plate, such as by molding or machining. In cross section, the extensions have the form of a finger extending outward from the outer surface of the wafer stop plate to make contact with the wafer. This extension "fingers" are fact circular (or annular) ridges having a somewhat conical shape and have the property that as the contact pressure between the face seals and the wafer increase, either as a result of increased pressing force of the wafer against the face seals or as a result of the increased pneumatic pressure applied within the pressure chambers, the strength of the seals is increased. The wafer stop plate has the same function as in the afore described embodiment as well as providing the seals. The wafer attachment stop plate operative during non polishing periods to prevent the wafer from flexing excessively from an applied vacuum force used to hold the wafer to the polishing head during wafer loading and unloading operations, except that as the stop plate includes the sealing ridges, where the ridges are sufficiently closely spaced, contact with the ridges is typically maintained and the wafer does not make contact with the main body of the stop plate.

When a face seal is formed integral with the stop plate, the material from which the wafer stop plate and integral face seals are formed should have the desired flexibility and resiliency to form a proper seal. Many polymeric materials have such properties, and the thickness of the stop plate main body portion and the seal portion may be adjusted to provide the desired stiffness of the main body portion and the desired resiliency in the seal portion. The vacuum force may be applied through the same holes or channels as the positive pressing force.

In an alternative embodiment, the plurality of face seals may be provided by structures fastened to the outer surface of the stop plate, such as for example rubber or polymeric tubes having an arbitrary cross section (round, square, triangular, hexagonal, or the like), O-rings. Attachment to the outer surface may be by means of a bonding such as with an adhesive, a close-fitting groove, or some other mechanical attachment.

By way of summary, the present embodiment provides a wafer polishing head for polishing a semiconductor wafer on a polishing pad, where the polishing head includes a retaining ring having an interior cylindrical surface and defining an interior cylindrical pocket sized to carry the wafer and to laterally restrain movement of the wafer when the wafer is moved relative to the polishing pad while being polished against the polishing pad and a wafer attachment stop plate attached to the retaining ring. The wafer attachment stop plate has a plurality of resilient concentric annular sealing ridges extending from a surface of the stop plate and defining independent pneumatic zones when pressed against a back side surface of the wafer, each the pneumatic zone being coupled for fluid communication to a source of pressurized pneumatic fluid. A first one of the plurality of resilient concentric annular sealing ridges is disposed adjacent the retaining ring interior cylindrical surface to receive the wafer and to support the wafer at a peripheral edge and define a first pneumatic zone, the first pneumatic zone being coupled for fluid communication to a first pressurized pneumatic fluid. A second one of the plurality of resilient concentric annular sealing ridges is disposed interior to the first annular sealing ridges and coupled for fluid communication to a second pressurized pneumatic fluid. The first and the pressurized fluids being adjusted to achieve a predetermined polishing pressures over a front side surface of the wafer.

#9. Embodiment of the Housing and Retaining Ring Attachment Structure.

Figure 14:
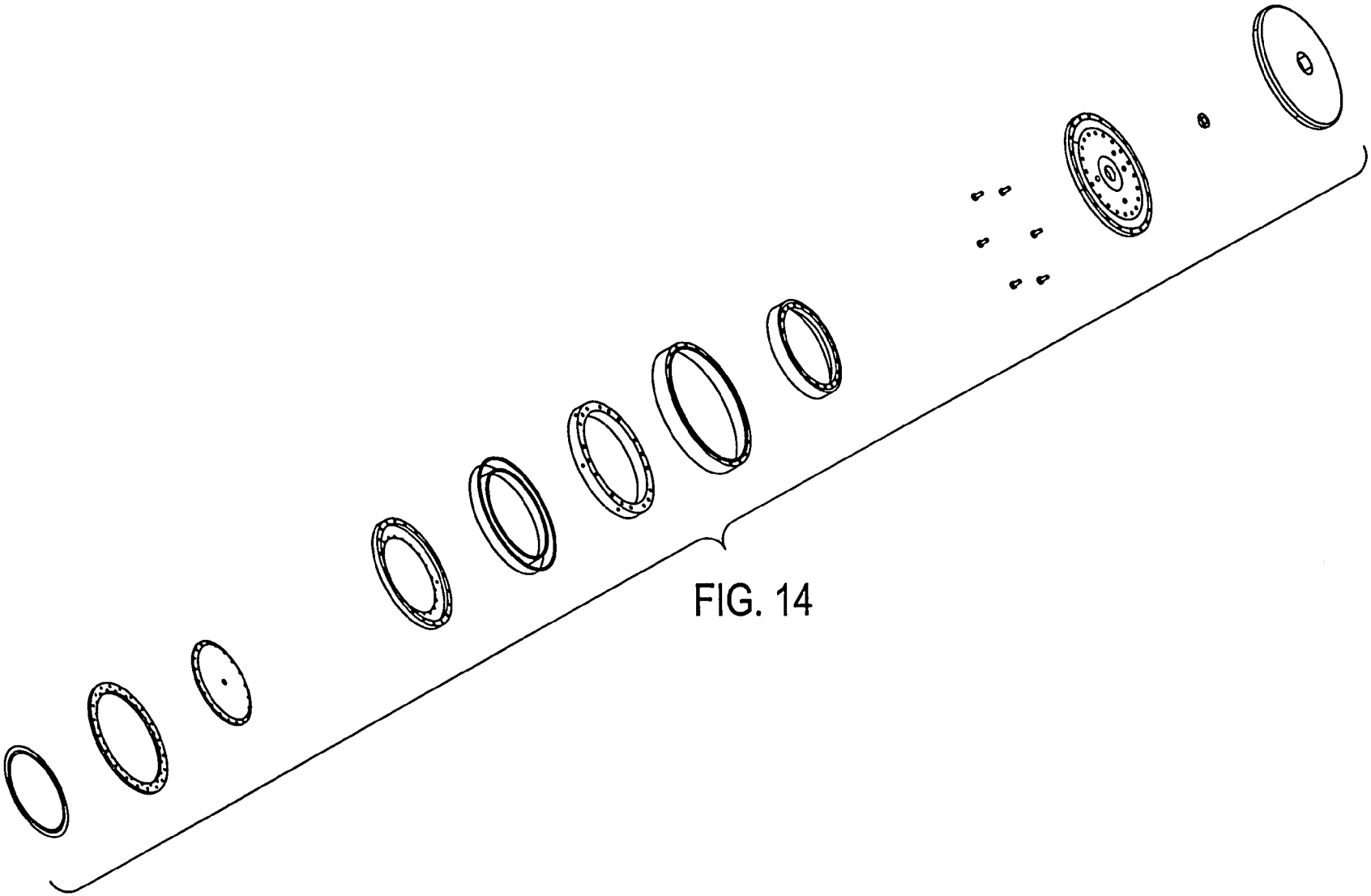
FIG. 14 is a diagrammatic illustration showing an exploaded assembly drawing of an embodiment of the insertless head, particularly adapted for 200 mm diameter wafers.
Figures 15A, 15B, 15C, 15D, 15E, 15F, 15G:
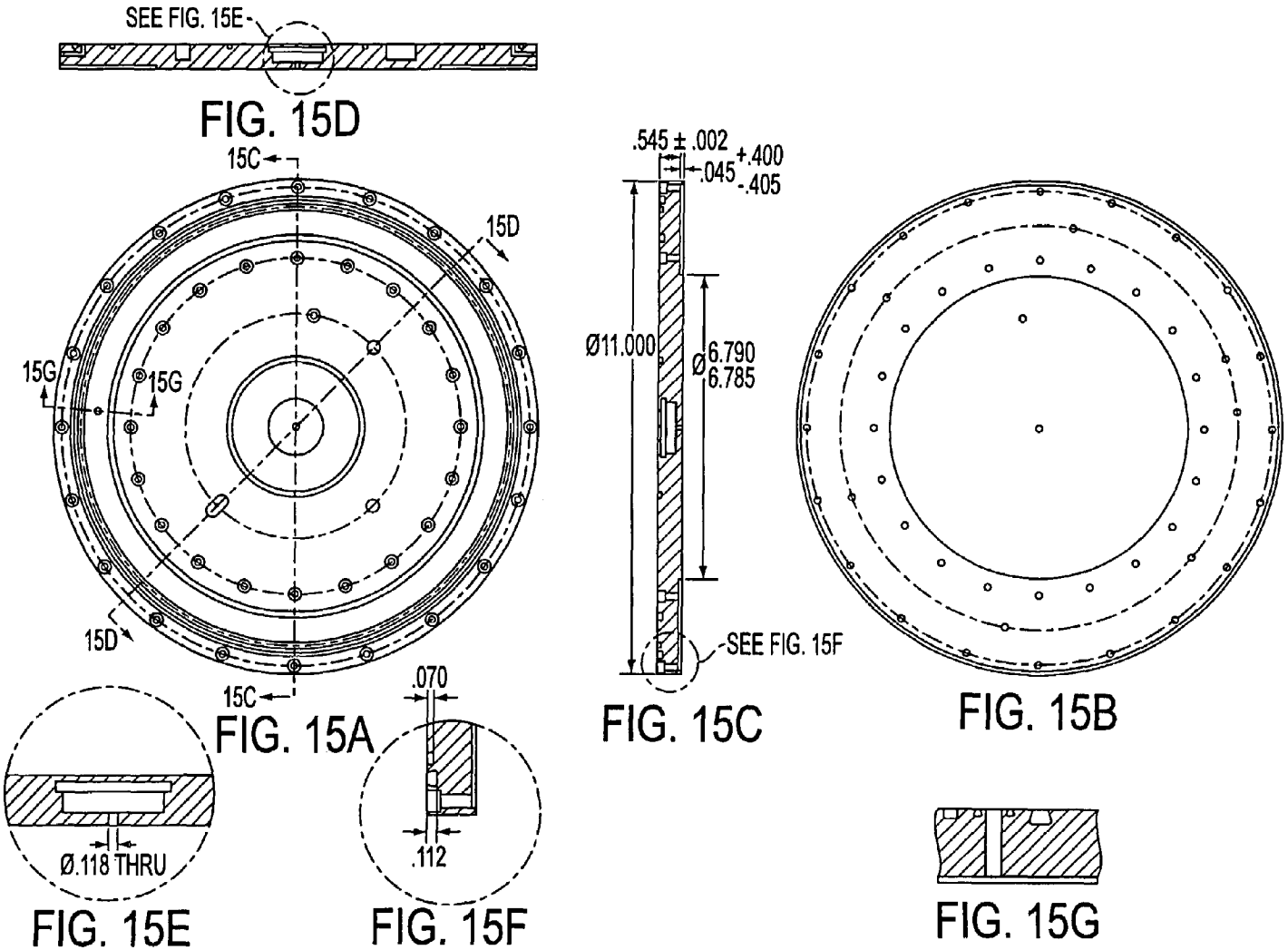
FIGS. 15A-15G are drawings showing features of a Top Housing for the embodiment of the Insertless Head.
Figure 16B:
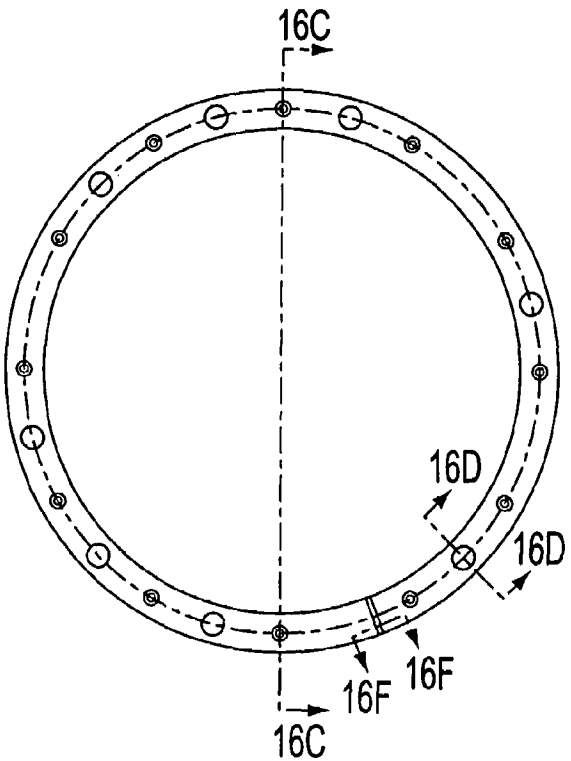
FIG. 16A-16F are drawings showing features of a Rolling Diaphragm Block.
Figure 16F:
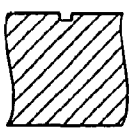
Figure 16C:
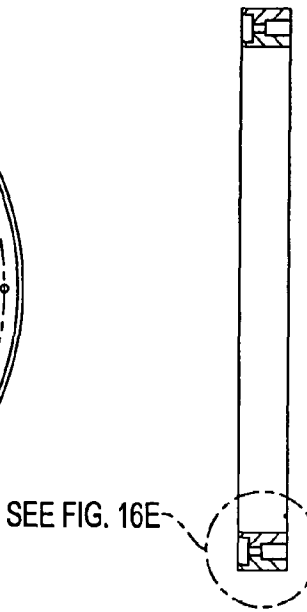
Figure 16E:
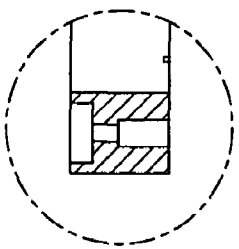
Figure 16A:
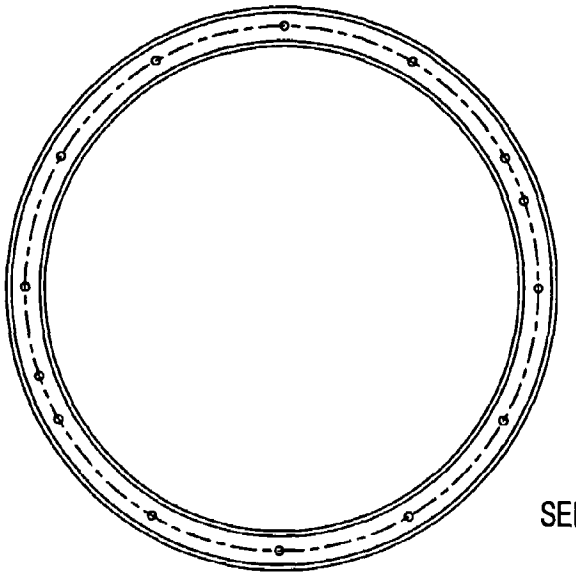
Figure 16D:
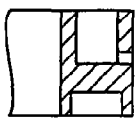
Figure 17C:
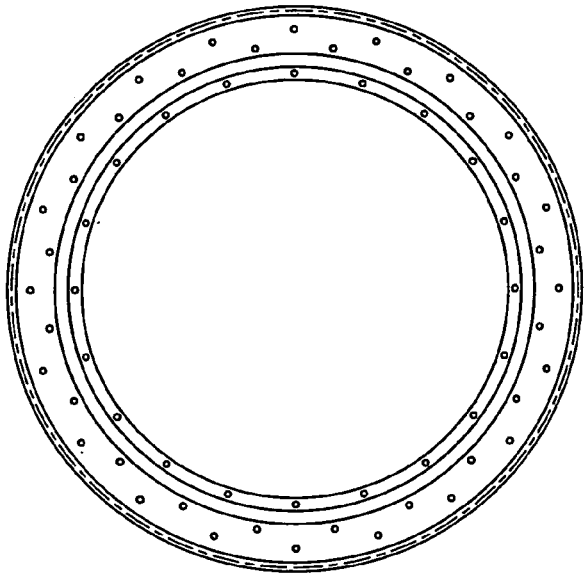
FIGS. 17A-17B are drawings showing features of an Adapter Retaining Ring Open Diaphragm.
Figure 17B:
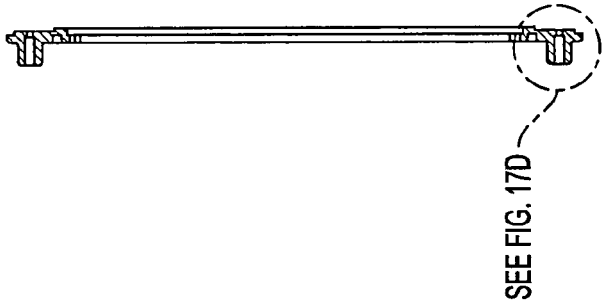
Figure 17D:
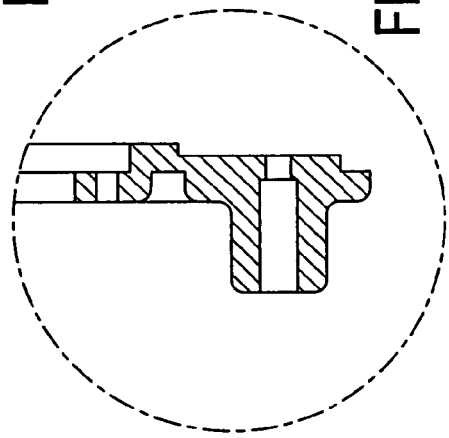
Figure 17A:
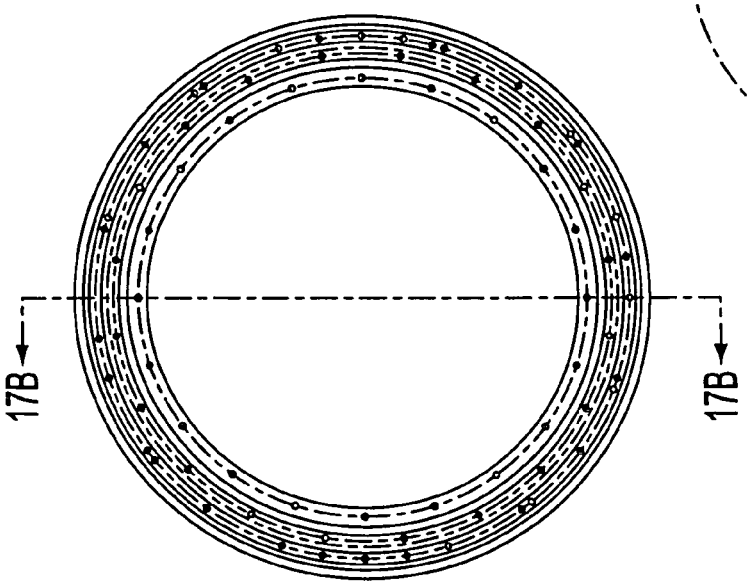
Figure 18A:
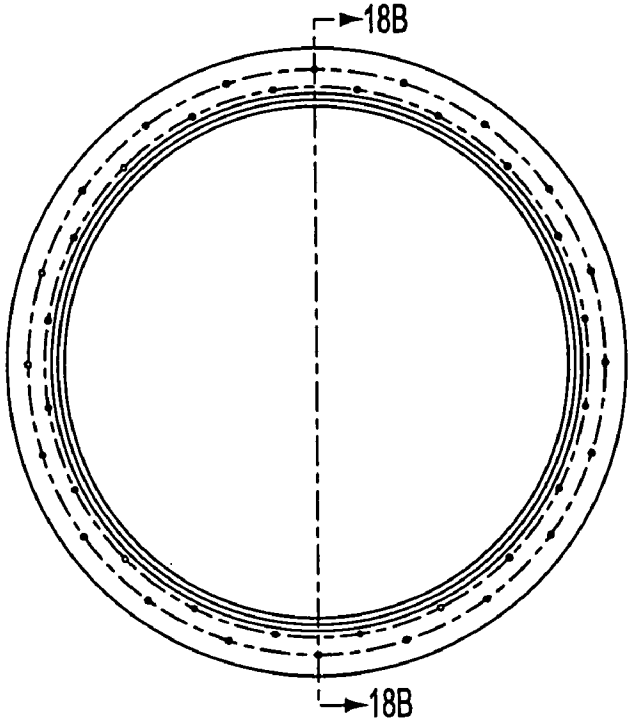
FIGS. 18A-18C are drawings showing features of a Ring Retaining.
Figure 18B:
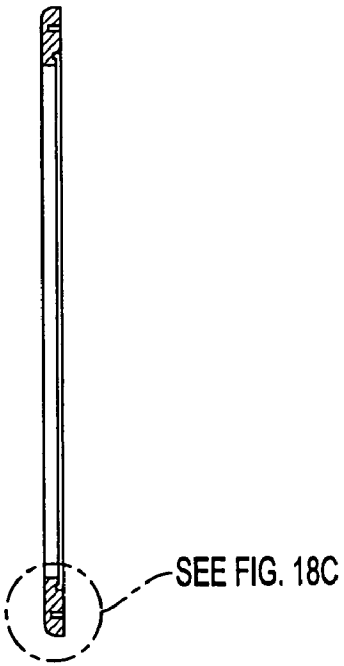
Figure 18C:
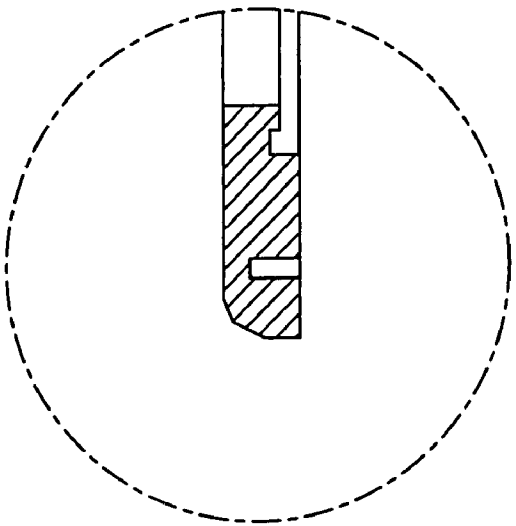
Figure 19C:
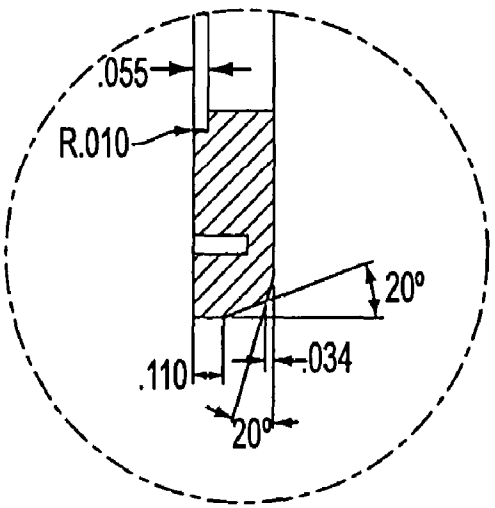
FIGS. 19A-19C are drawings showing features of a Ring Retaining Open Diaphragm.
Figure 19B:
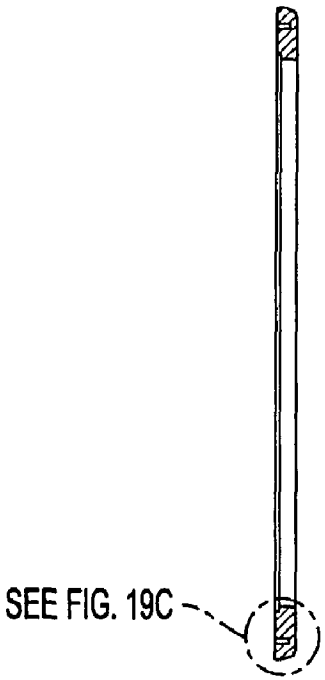
Figure 19A:
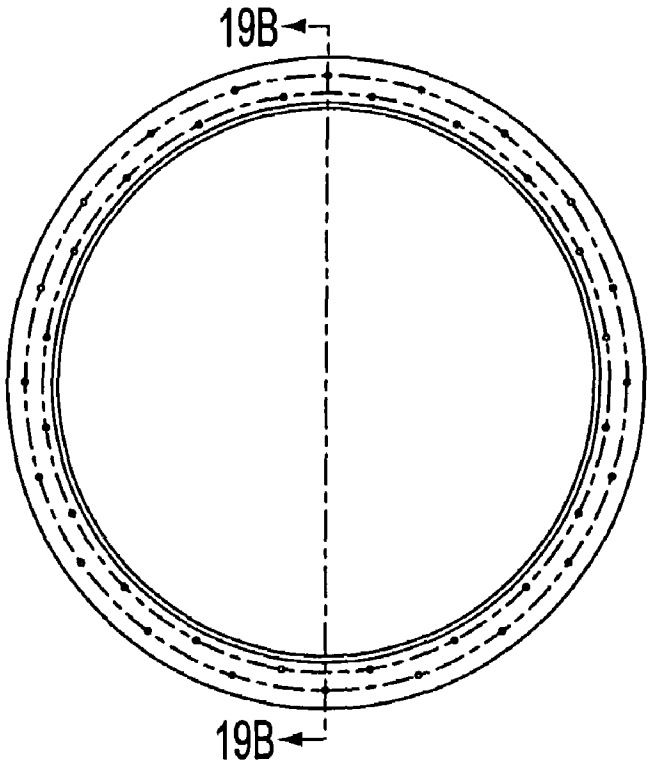
Figure 20B:
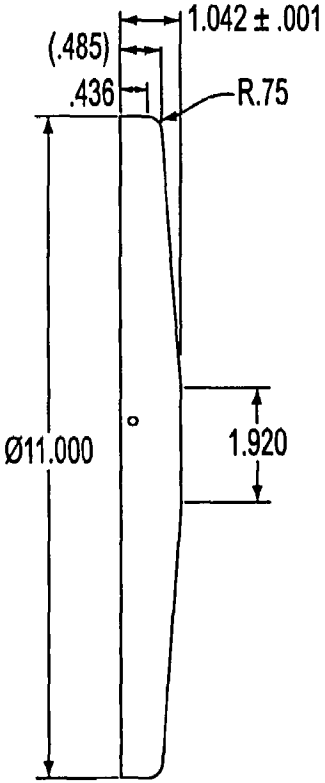
FIGS. 20A-20H are drawings showing features of a Quick Release Adapter.
Figure 20A:
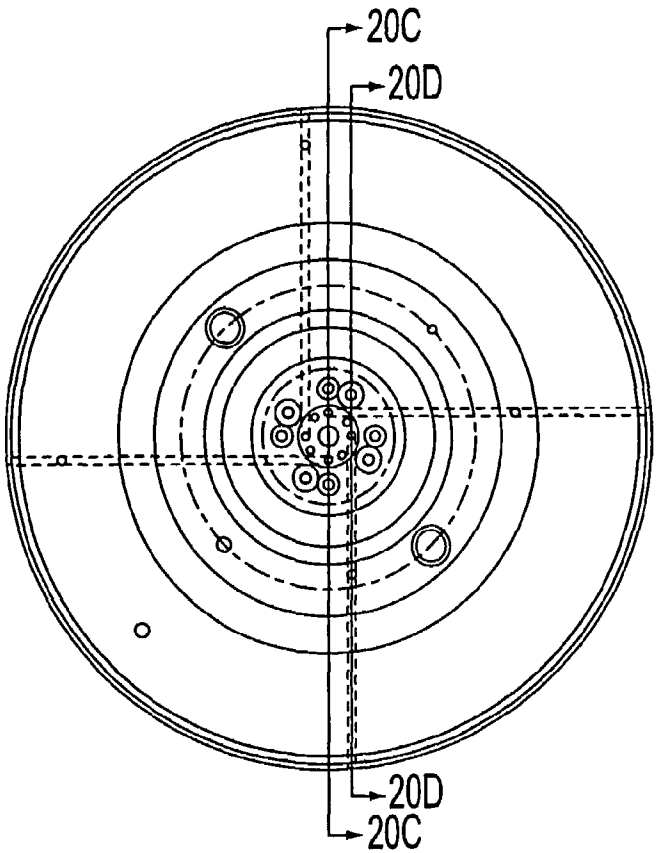
Figure 20C:
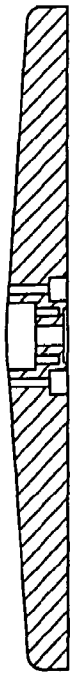
Figure 20D:
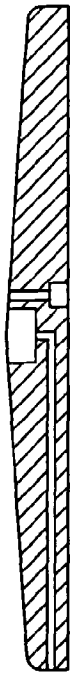
Figure 20H:
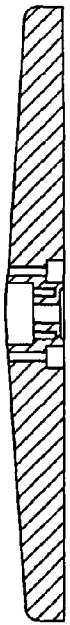
Figure 20G:
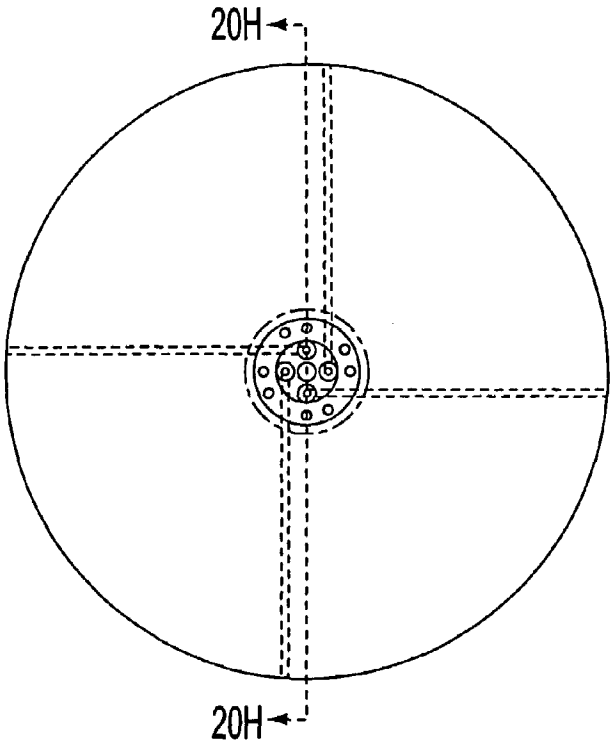
Figure 20F:
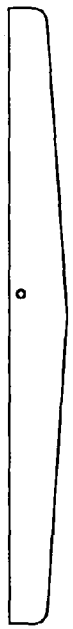
Figure 20E:
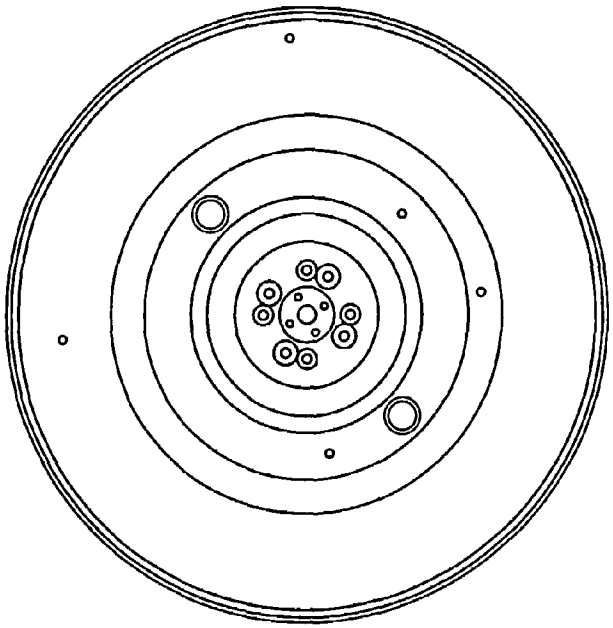
Figure 21A:
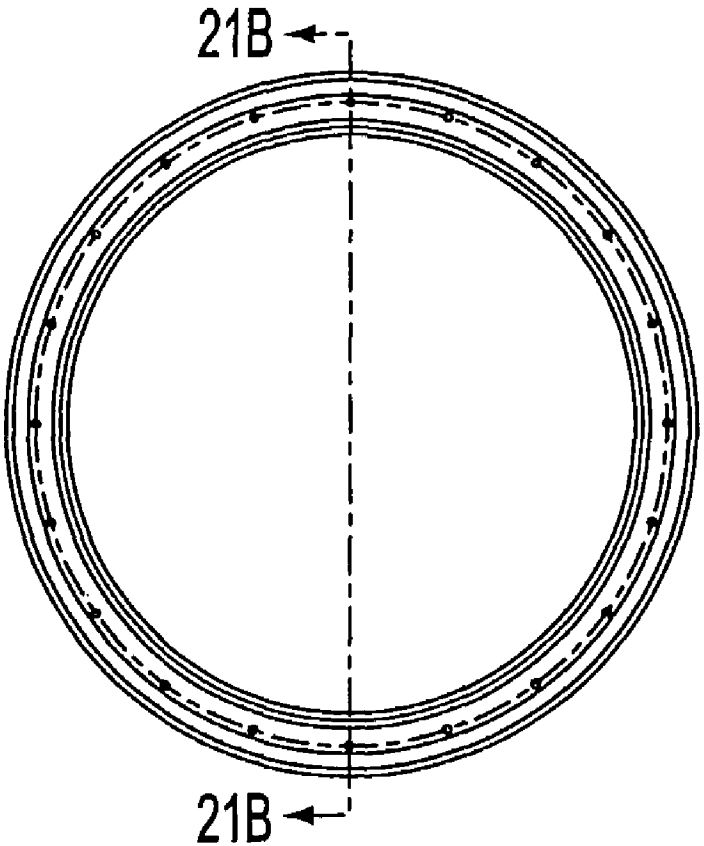
FIGS. 21A-21B are drawings showing features of an Inner Housing.
Figure 21B:
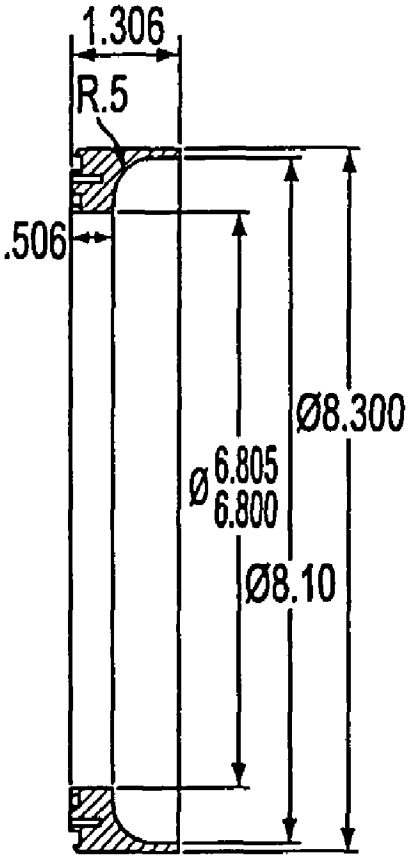
Figure 22B:
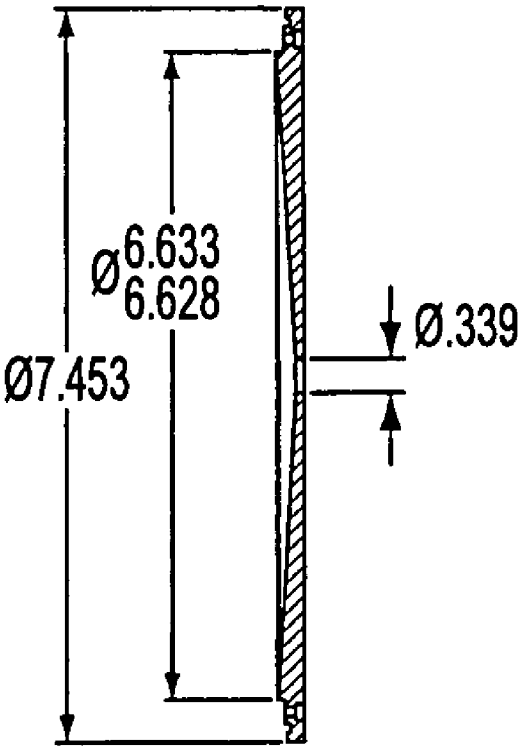
FIGS. 22A-22B are drawings showing features of a Vacuum Plate.
Figure 22A:
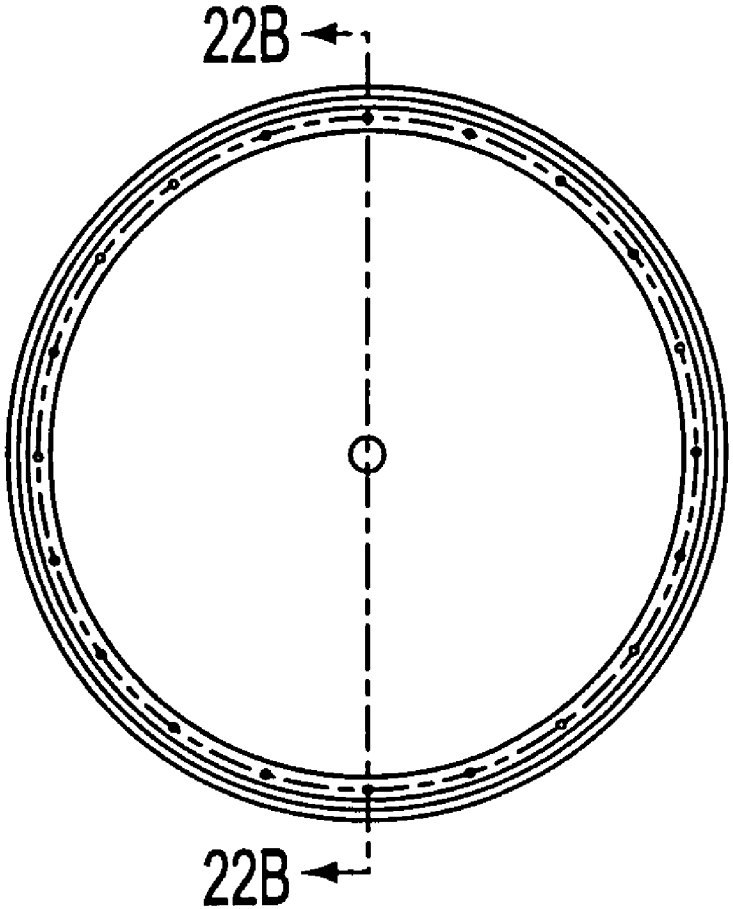
Figure 23C:
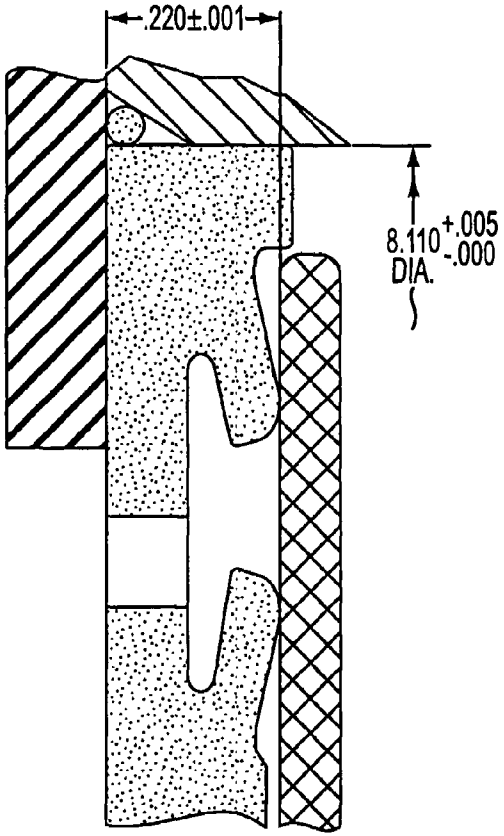
FIGS. 23A-23C are drawings showing features of an exemplary 206 mm Outer Diameter Seal Assembly.
Figure 23A:
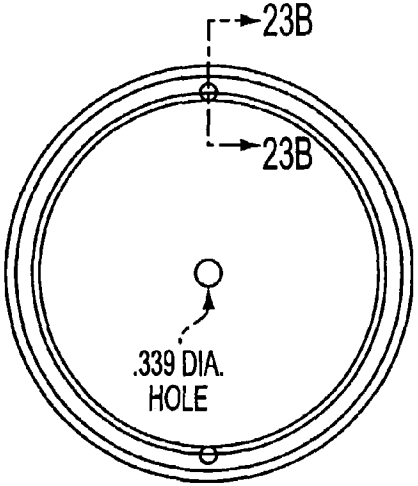
Figure 23B:
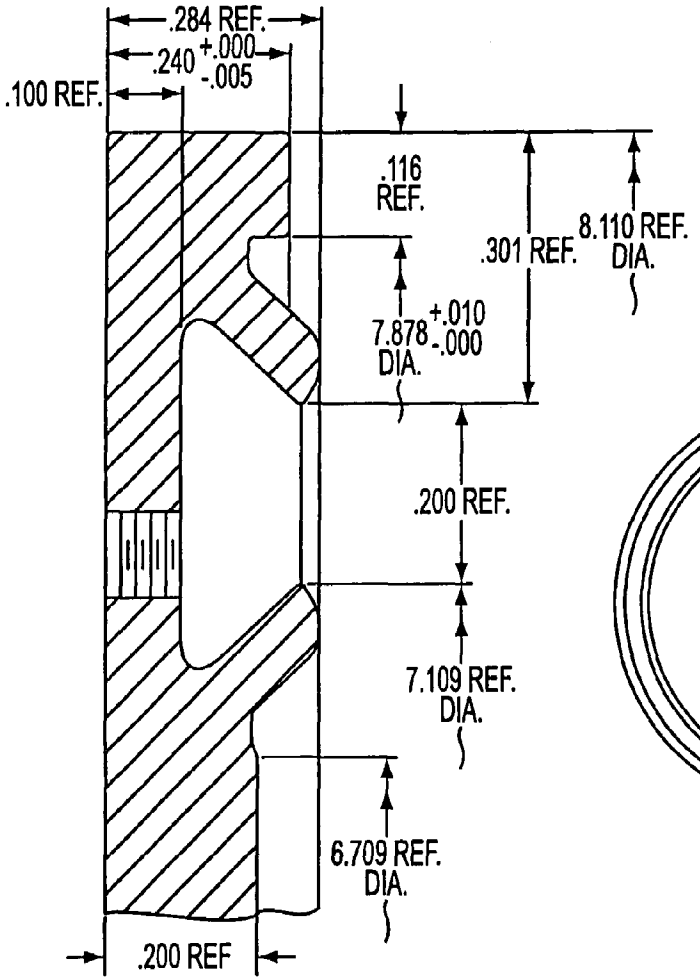

The embodiments of the invention illustrated in FIG. 10, FIG. 11, FIG. 12, and FIG. 13 were described relative to a particular polishing head carrier assembly, referred to as an "insertless head". While this particular carrier assembly is not required for practicing the inventive embodiments already-described, it may preferably be used with the afore described embodiments and is therefore disclosed here. More particularly, in FIG. 14 there is illustrated an exploaded assembly drawing of an embodiment of the insertless head, particularly adapted for 200 mm diameter wafers, but with modification adaptable for other sizes. FIGS. 15A-15G are drawings showing features of a Top Housing for the embodiment of the Insertless Head. FIGS. 16A-16F are drawings showing features of a Rolling Diaphragm Block. FIGS. 17A-17B are drawings showing features of an Adapter Retaining Ring Open Diaphragm. FIGS. 18A-18C are drawings showing features of a Ring Retaining. FIGS. 19A-19C are drawings showing features of a Ring Retaining Open Diaphragm. FIGS. 20A-20H are drawings showing features of a Quick Release Adapter. FIGS. 21A-21B are drawings showing features of an Inner Housing. FIGS. 22A-22B are drawings showing features of a Vacuum Plate. FIGS. 23A-23C are drawings showing features of an exemplary 206 mm Outer Diameter Seal Assembly.

All publications, patents, and patent applications mentioned in this specification are herein incorporated by reference to the same extent as if each individual publication or patent application was specifically and individually indicated to be incorporated by reference.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the Claims appended hereto and their equivalents.

What is claimed is:

1. A method for processing a substrate having a front side surface and a backside surface on a processing tool, said method comprising:

defining a first annular pressure zone with a first sealing member;

defining a second pressure zone radially interior to said first zone with a second sealing member;

developing first and second pressures respectively in said first and said second pressure zones;

contacting said backside surface of said substrate with said first and second sealing members without an intervening structure so that said front side surface of said substrate is pressed against said processing tool according to said defined first and second pressures; and adjusting said first and second pressures to achieve a desired substrate material remove characteristic across said front side surface of said substrate.

2. The method in claim 1, further comprising the steps of:

retaining said substrate within a cylindrical pocket defined by a retaining ring and sized to carry said substrate and to laterally restrain movement of said substrate when said substrate is moved relative to said processing tool during processing; and defining an annular retaining ring pressure zone surrounding and substantially concentric with said first annular pneumatic pressure zone to press a contact surface of a retaining ring against said processing tool during processing.

3. The method of claim 2, wherein said annular retaining ring pressure zone is defined to be a pressure that alters a substrate material removal rate proximate a peripheral edge of said substrate to reduce under removal or over removal of material from a front side surface of said substrate relative to interior portions of said substrate.

4. The method in claim 1, wherein said substrate material removal comprises substantially uniform material removal across said front side surface of said substrate.

5. The method in claim 1, wherein said substrate comprises a semiconductor material.

6. A wafer polishing head for polishing a semiconductor wafer on a polishing pad, said polishing head comprising:

a retaining ring having an interior cylindrical surface and defining an interior cylindrical pocket sized to carry said wafer and to laterally restrain movement of said wafer when said wafer is moved relative to said polishing pad while being polished against said polishing pad;

a wafer attachment stop plate attached to said retaining ring;

a resilient pneumatic annular sealing bladder coupled for fluid communication to a first pressurized pneumatic fluid to define a first pneumatic zone and attached to a first surface of said wafer stop plate adjacent said retaining ring interior cylindrical surface to receive said wafer and to support said wafer at a peripheral edge;

said resilient pneumatic annular sealing bladder defining a second pneumatic zone radially interior to said first pneumatic zone and extending between said first surface of said wafer stop plate and said wafer when said wafer is attached to said polishing head during a polishing operation and coupled for fluid communication to a second pressurized pneumatic fluid, said first surface of said wafer stop plate not being in contact with a wafer back side surface during polishing of said wafer;

said wafer attachment stop plate operative during non polishing periods to prevent said wafer from flexing excessively from an applied vacuum force used to hold said wafer to said polishing head during wafer loading and unloading operations;

said first and said pressurized fluids being adjusted to achieve a predetermined polishing pressure over a front side surface of said wafer.

7. A wafer polishing head for polishing a semiconductor wafer on a polishing pad, said polishing head comprising:

a retaining ring having an interior cylindrical surface and defining an interior cylindrical pocket sized to carry said wafer and to laterally restrain movement of said wafer when said wafer is moved relative to said polishing pad while being polished against said polishing pad;

a wafer attachment stop plate attached to said retaining ring;

a resilient seal disposed adjacent said retaining ring interior cylindrical surface to receive said wafer and to support said wafer at a peripheral edge and defining a first pneumatic zone when said wafer has been coupled for fluid communication to a first pressurized pneumatic fluid;

said wafer attachment stop plate operative during non polishing periods to prevent said wafer from flexing excessively from an applied vacuum force used to hold said wafer to said polishing head during wafer loading and unloading operations;

said first and said pressurized fluids being adjusted to achieve a predetermined polishing pressure over a front side surface of said wafer.

8. A wafer polishing head for polishing a semiconductor wafer on a polishing pad, said polishing head comprising:

a retaining ring having an interior cylindrical surface and defining an interior cylindrical pocket sized to carry said wafer and to laterally restrain movement of said wafer when said wafer is moved relative to said polishing pad while being polished against said polishing pad;

a wafer attachment stop plate attached to said retaining ring;

a plurality of resilient pneumatic bladders attached to a first surface of said wafer stop plate, each said bladder being coupled for fluid communication to a source of pressurized pneumatic fluid;

a first one of said plurality of resilient pneumatic bladders having an annular shape and disposed adjacent said retaining ring interior cylindrical surface to receive said wafer and to support said wafer at a peripheral edge, said first bladder being coupled for fluid communication to a first pressurized pneumatic fluid;

a second one of said plurality of resilient pneumatic bladders being disposed interior to said annular shaped first bladder and coupled for fluid communication to a second pressurized pneumatic fluid;

said first and said pressurized fluids being adjusted to achieve a predetermined polishing pressure over a front side surface of said wafer.

9. A wafer polishing head for polishing a semiconductor wafer on a polishing pad, said polishing head comprising:

a retaining ring having an interior cylindrical surface and defining an interior cylindrical pocket sized to carry said wafer and to laterally restrain movement of said wafer when said wafer is moved relative to said polishing pad while being polished against said polishing pad;

a wafer attachment stop plate attached to said retaining ring;

said wafer attachment stop plate having a plurality of resilient concentric annular sealing ridges extending from a surface of said stop plate and defining independent pneumatic zones when pressed against a back side surface of said wafer, each said pneumatic zone being coupled for fluid communication to a source of pressurized pneumatic fluid;

a first one of said plurality of resilient concentric annular sealing ridges being disposed adjacent said retaining ring interior cylindrical surface to receive said wafer and to support said wafer at a peripheral edge and defining a first pneumatic zone, said first pneumatic zone being coupled for fluid communication to a first pressurized pneumatic fluid;

a second one of said plurality of resilient concentric annular sealing ridges being disposed interior to said first annular sealing ridge and coupled for fluid communication to a second pressurized pneumatic fluid;

said first and said pressurized fluids being adjusted to achieve a predetermined polishing pressure over a front side surface of said wafer.

* * * * *